US008431888B2

(12) United States Patent
Kennedy et al.

(10) Patent No.: US 8,431,888 B2
(45) Date of Patent: Apr. 30, 2013

(54) ELECTROSPRAY AND NANOSPRAY IONIZATION OF DISCRETE SAMPLES IN DROPLET FORMAT

(75) Inventors: Robert Kennedy, Ann Arbor, MI (US); Jian Pei, Agoura Hills, CA (US); Qiang Li, Saginaw, MI (US); Mike S. Lee, Newtown, PA (US); Gary A. Valaskovic, Cambridge, MA (US)

(73) Assignee: The Regents of The University of Michigan, Ann Arbor, MI (US)

( * ) Notice: Subject to any disclaimer, the term of this patent is extended or adjusted under 35 U.S.C. 154(b) by 0 days.

(21) Appl. No.: 13/378,858

(22) PCT Filed: Jun. 18, 2010

(86) PCT No.: PCT/US2010/039233

§ 371 (c)(1),
(2), (4) Date: Dec. 16, 2011

(87) PCT Pub. No.: WO2010/148339

PCT Pub. Date: Dec. 23, 2010

(65) Prior Publication Data

US 2012/0153143 A1 Jun. 21, 2012

Related U.S. Application Data

(60) Provisional application No. 61/218,454, filed on Jun. 19, 2009.

(51) Int. Cl.
*H01J 49/26* (2006.01)

(52) U.S. Cl.
USPC ..... 250/288; 250/282; 250/423 R; 250/424

(58) Field of Classification Search ..... 250/282, 250/288, 423 R, 424
See application file for complete search history.

(56) References Cited

U.S. PATENT DOCUMENTS 5,504,327 A * 4/1996 Sproch et al. ..... 250/288
5,505,832 A * 4/1996 Laukien et al. ..... 204/452
5,993,633 A * 11/1999 Smith et al. ..... 204/601

FOREIGN PATENT DOCUMENTS

KR 2001-0062226 A 7/2001

OTHER PUBLICATIONS

International Search Report and Written Opinion for PCT/US2010/039233, mailed Mar. 2, 2011; ISA/KR.

* cited by examiner

*Primary Examiner* — Michael Logie
(74) *Attorney, Agent, or Firm* — Harness, Dickey & Pierce, P.L.C.

(57) ABSTRACT

Droplets or plugs within multiphase microfluidic systems have rapidly gained interest as a way to manipulate samples and chemical reactions on the femtoliter to microliter scale. Chemical analysis of the plugs remains a challenge. It has been discovered that nanoliter plugs of sample separated by air or oil can be analyzed by electrospray ionization mass spectrometry when pumped directly into a fused silica nanospray emitter nozzle. Using leu-enkephalin in methanol and 1% acetic acid in water (50:50 v:v) as a model sample, we found carry-over between plugs was <0.1% and relative standard deviation of signal for a series of plugs was 3%. Detection limits were 1 nM. Sample analysis rates of 0.8 Hz were achieved by pumping 13 nL samples separated by 3 mm long air gaps in a 75 μm inner diameter tube. Analysis rates were limited by the scan time of the ion trap mass spectrometer. The system provides a robust, rapid, and information-rich method for chemical analysis of sample in segmented flow systems.

31 Claims, 28 Drawing Sheets

ELECTROSPRAY AND NANOSPRAY IONIZATION OF DISCRETE SAMPLES IN DROPLET FORMAT

CROSS-REFERENCE TO RELATED APPLICATIONS

Figure 1:
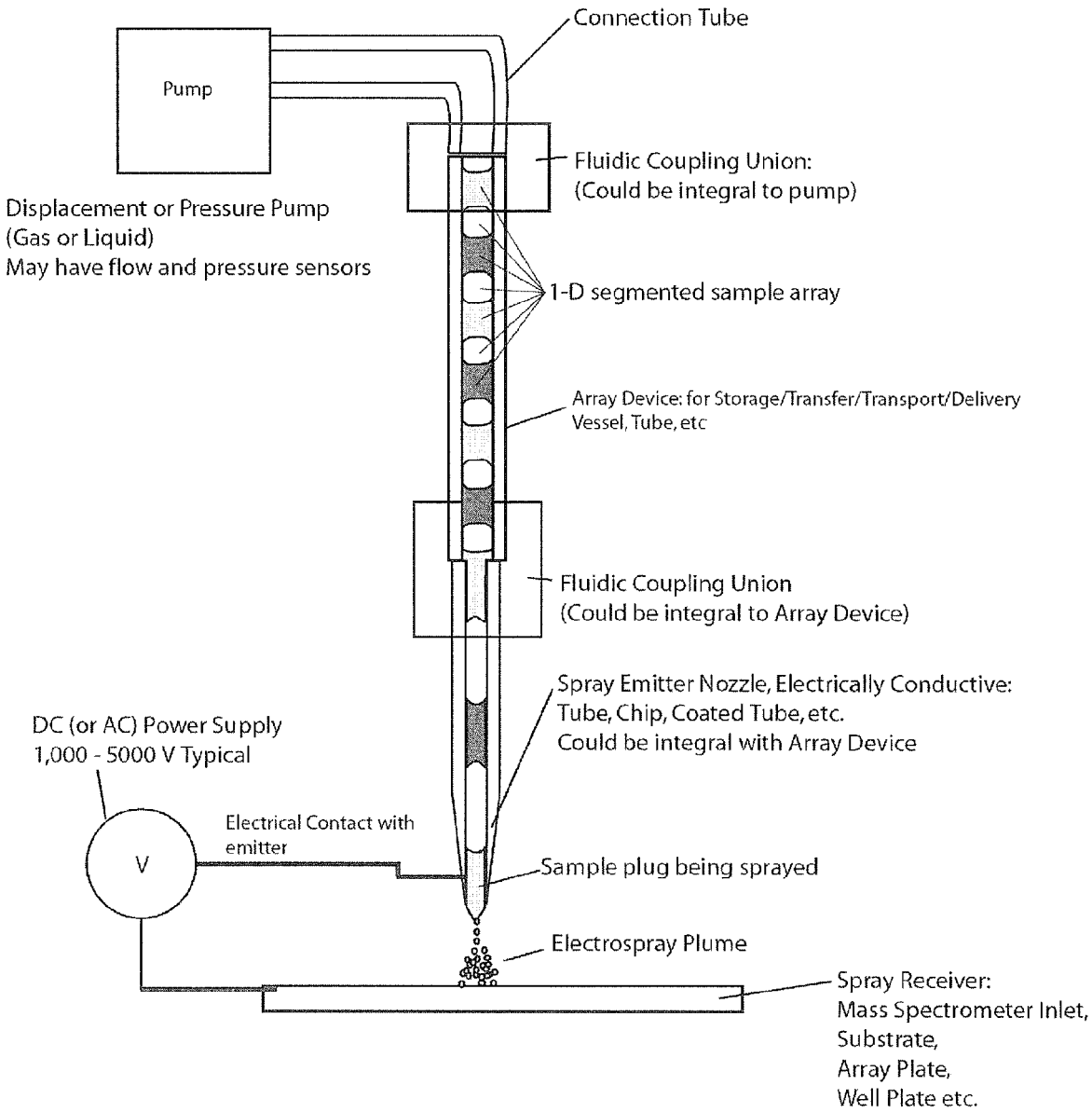
Figure 1:
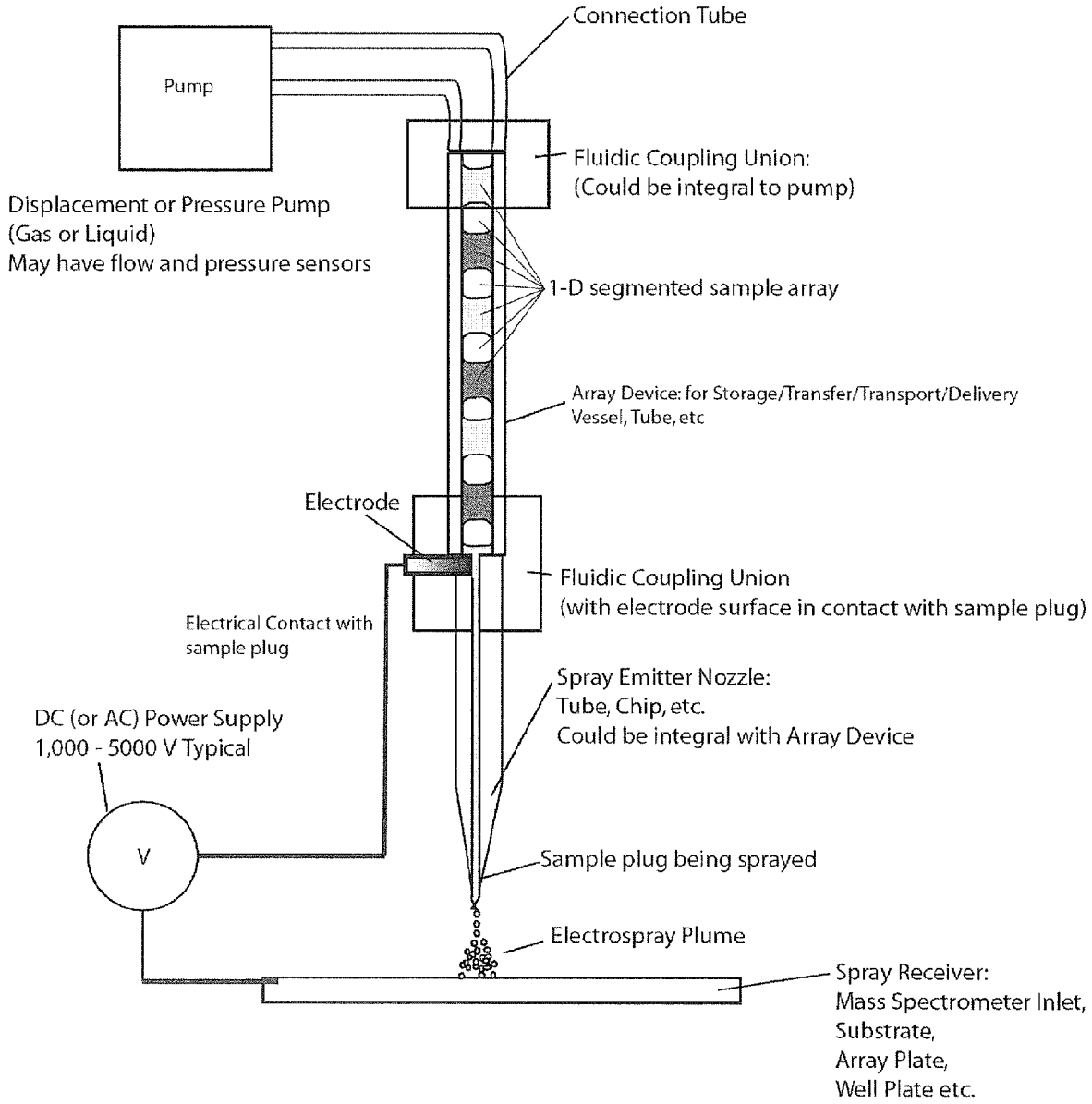

This application is a 371 U.S. National Stage of International Application No. PCT/US2010/039233, filed Jun. 18, 2010, and claims the benefit of U.S. Provisional Application No. 61/218,454, filed on Jun. 19, 2009. The entire disclosures of the above applications are incorporated herein by reference.

GOVERNMENT RIGHTS

This invention was made with government support under Grant CHE-0514638 awarded by the National Science Foundation and Grant R37 EB003220 awarded by the National Institutes of Health. The government has certain rights in the invention.

A paper copy of the Sequence Listing submitted under 37 CFR 1.821 is incorporated herein by reference. A computer readable form of the Sequence Listing, contained in the file name "2115-004419-SEQ_LIST.txt" is incorporated herein by reference. This Sequence Listing was created on Jun. 14, 2010, contains 741 bytes of information and consists of SEQ ID NO:1.

INTRODUCTION

This section provides background information related to the present disclosure that is not necessarily prior art.

Multiphase flow in capillary or microfluidic systems has generated considerable interest as a way to partition and process many discrete samples or synthetic reactions in confined spaces. A common arrangement is a series of aqueous plugs or droplets (i.e., sample plugs) separated by gas or immiscible liquid (i.e., spacer plugs) such that each sample plug can act as a small, individual vial or reaction vessel.

Methods for formation and manipulation of plugs on the femtoliter to microliter scale have been developed. The sophistication of these methods has rapidly increased so that it is now possible to perform many common laboratory functions such as sampling, splitting, reagent addition, concentration, and dilution on plugs in microfluidic systems. A frequent emphasis is that such manipulations can be performed automatically at high-throughput. These miniaturized multiphase flow systems have roots in the popular technique of continuous flow analysis (also known as segmented flow analysis) which can use air-segmentation of samples, for example, for high-throughput assays in clinical, industrial, and environmental applications.

A limiting factor in using and studying multiphase flows is the paucity of methods to chemically analyze the contents of plugs. Optical methods such as colorimetry and fluorescence are commonly used. Systems for electrophoretic analysis of segmented flows have been developed. Drawbacks of these methods are that they require that the analytes be labeled to render them detectable and they provide little information on chemical identity of plug contents. NMR has been used for analysis of plugs, but low sensitivity of this method limits its potential applications. Sensitive, label-free, and information rich detection would greatly aid development of this technology platform.

Further areas of applicability will become apparent from the description provided herein. The description and specific examples in this summary are intended for purposes of illustration only and are not intended to limit the scope of the present disclosure.

SUMMARY

The present technology includes systems and methods that relate to electrospray of one-dimensional segmented sample arrays.

In some embodiments, a system for electrospray ionization of discrete samples comprises an electrospray ionization emitter nozzle, a one-dimensional segmented sample array, a pumping means, and a power supply. The array is directly coupled to the nozzle, where the array includes a plurality of sample plugs including a first medium separated by spacer plugs including a second medium. The first medium and second medium can be immiscible or the first medium may comprise a liquid and the second medium may comprise a gas. Direct coupling of the array to the nozzle maintains the sample plugs as segments at the entry to the nozzle; i.e., the sample plugs are not desegmented prior to entering the nozzle. The pumping means is operable to advance the array to the electrospray ionization emitter nozzle and can be provided by suitable means including a syringe pump, reciprocating piston pump, peristaltic pump, gas-pressure pump, electroosmosis, or gravity. The power supply is electrically coupled to a sample plug within or proximate to the nozzle and is also electrically coupled to a spray receiver. The spray receiver can further comprise a mass spectrometer.

In some embodiments, a method of operating a system for electrospray ionization of discrete samples comprises advancing the one-dimensional segmented sample array to the electrospray ionization emitter nozzle with the pump and electrospraying a sample plug. The one-dimensional segmented sample array may also be formed off-line whereupon the array is directly coupled to the electrospray ionization emitter nozzle. In some cases, liquid chromatography fractions can be collected at a first rate in forming the one-dimensional segmented sample array followed by advancing the one-dimensional segmented sample array to the electrospray ionization emitter nozzle at a second rate, where the first rate and the second rate are different. When the first medium comprises an aqueous medium and the second medium comprises a hydrophobic medium, such as oil, the method can include adjusting the electrospray voltage to electrospray the first medium and to not electrospray the second medium. The second medium may form a droplet on the nozzle that is then removed instead of electrosprayed.

DRAWINGS

The drawings described herein are for illustrative purposes only of selected embodiments and not all possible implementations, and are not intended to limit the scope of the present disclosure.

FIG. 1. (a) Generic view of a system illustrating array of plugs in flow path and electrospray emitter. AC, DC, and switching voltages may be used for the electrospray. The receiver, which is the counter-electrode for the electrospray process, may be a mass spectrometer inlet, a surface to be coated, a well plate, or tray for sample deposition. In this case, the voltage contact is directly with the sample plug being sprayed by using either an electrically conductive emitter or a non-conductive emitter having a conductive coating. (b) Shows a view of a system as per panel (a), except that the voltage contact with the sample plug is located at the distal end of the emitter nozzle. This configuration can be particularly effective when using an emitter nozzle fabricated from non-conductive materials.

Figure 2:
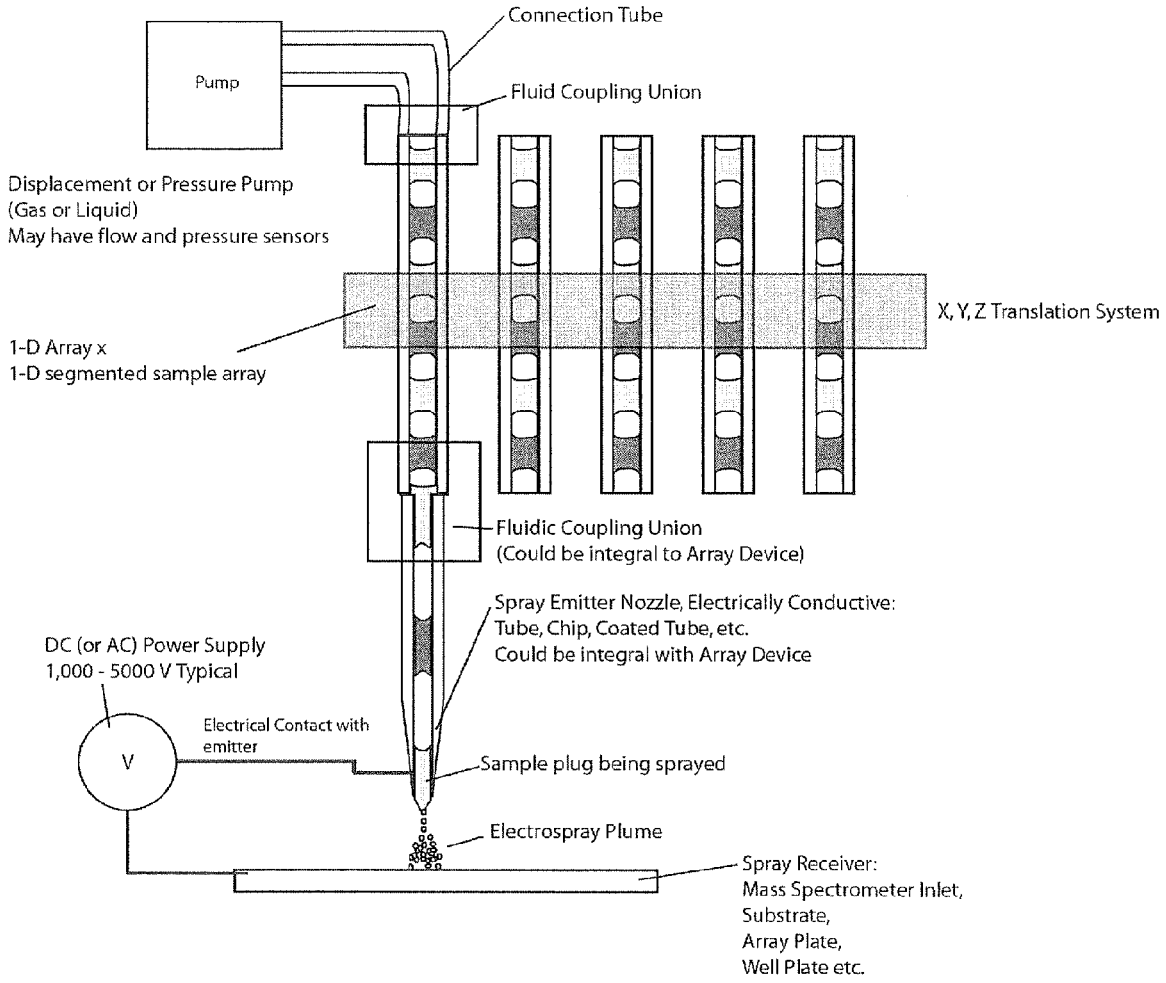

FIG. 2. Embodiment of system with parallel configuration of fluidic segments and a single electrospray emitter and receiver. In this case, a single emitter and pump is used and each array is translated to the emitter.

Figure 3:
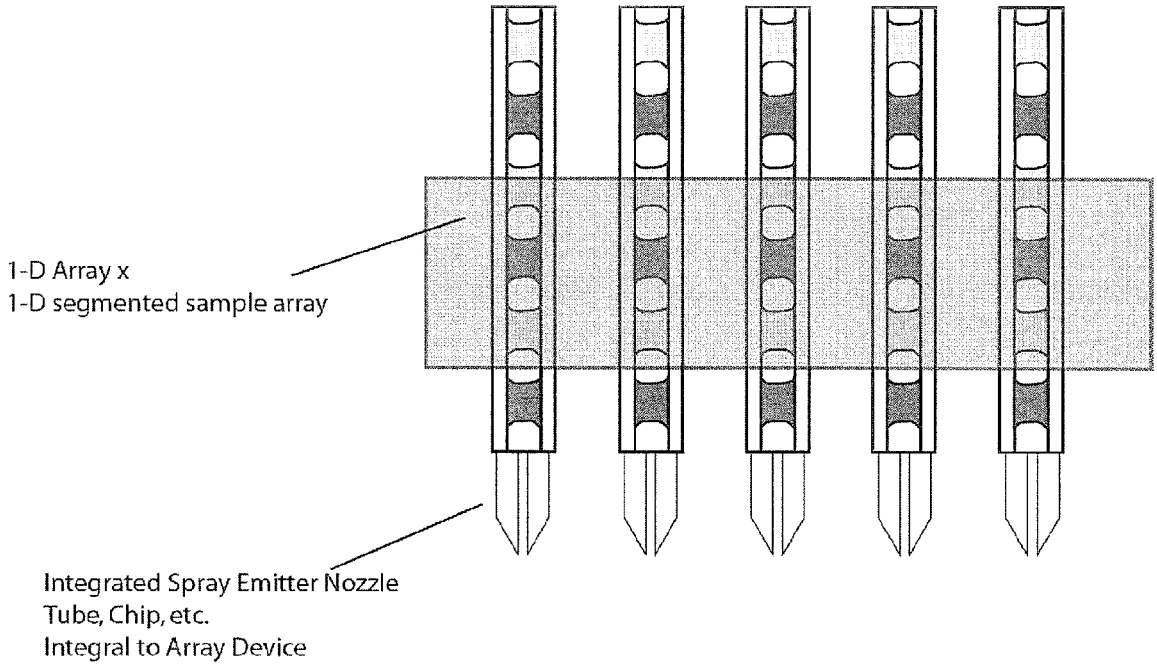

FIG. 3. Embodiment of system with parallel configuration of fluidic segment tubes, each with an individual emitter. Ancillary equipment omitted for clarity.

Figure 4:
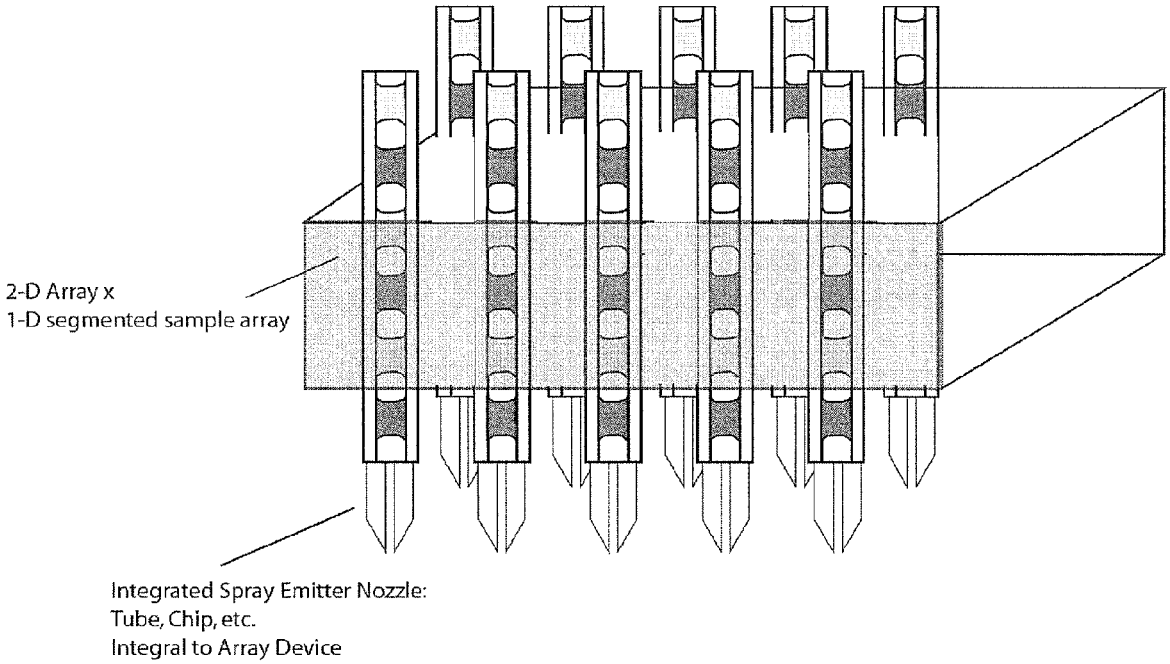

FIG. 4. Embodiment of system with 2-dimensional array of fluidic segment tubes each with an individual emitter. Ancillary equipment omitted for clarity.

Figure 5:
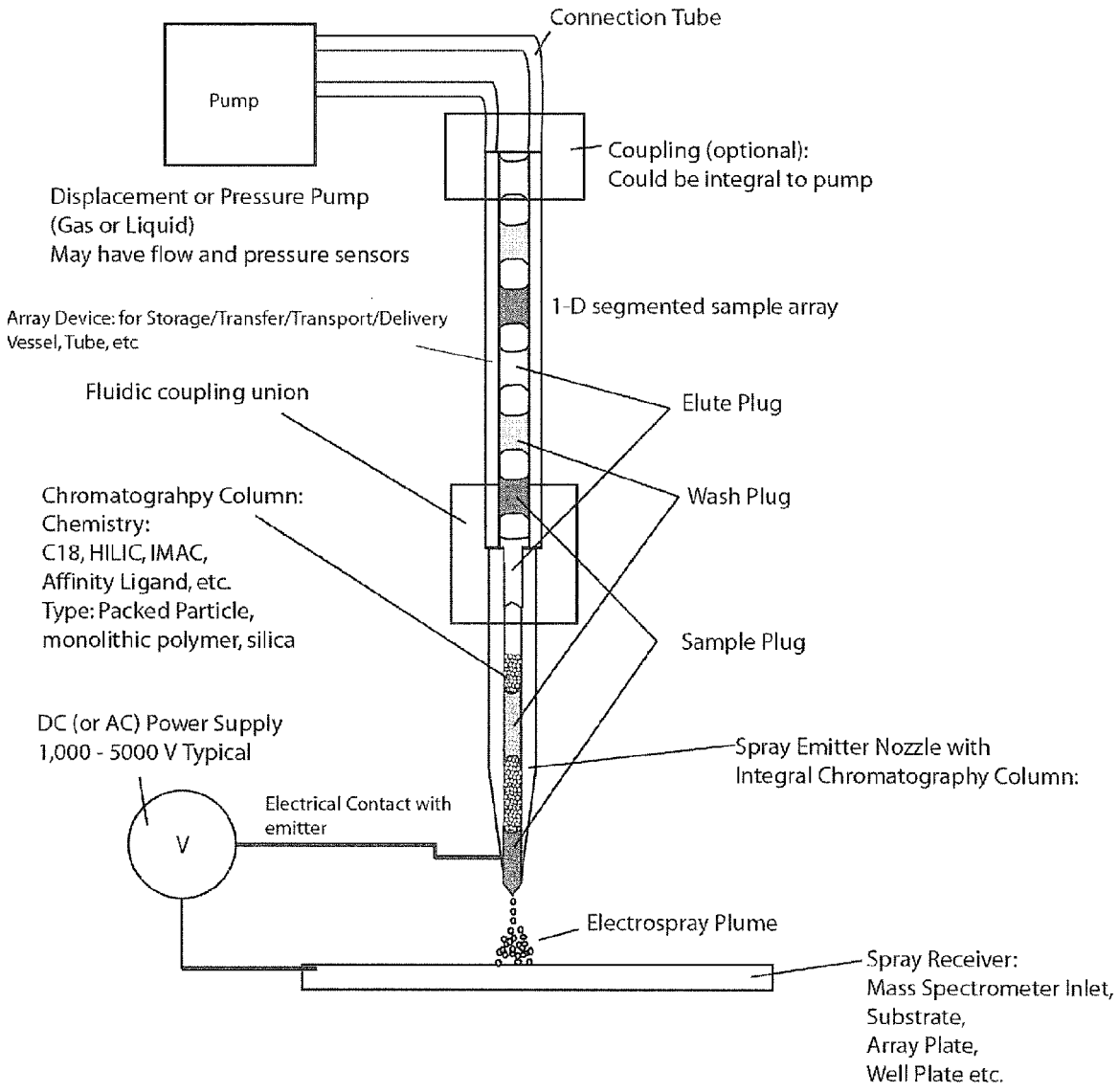

FIG. 5. Embodiment of system that contains a chromatography or solid phase extraction column within or in front of the emitter nozzle. Plugs are used to perform sequential loading, extractions, and elution from the column. Columns may be of packed, monolithic, or open tubular format.

Figure 6:
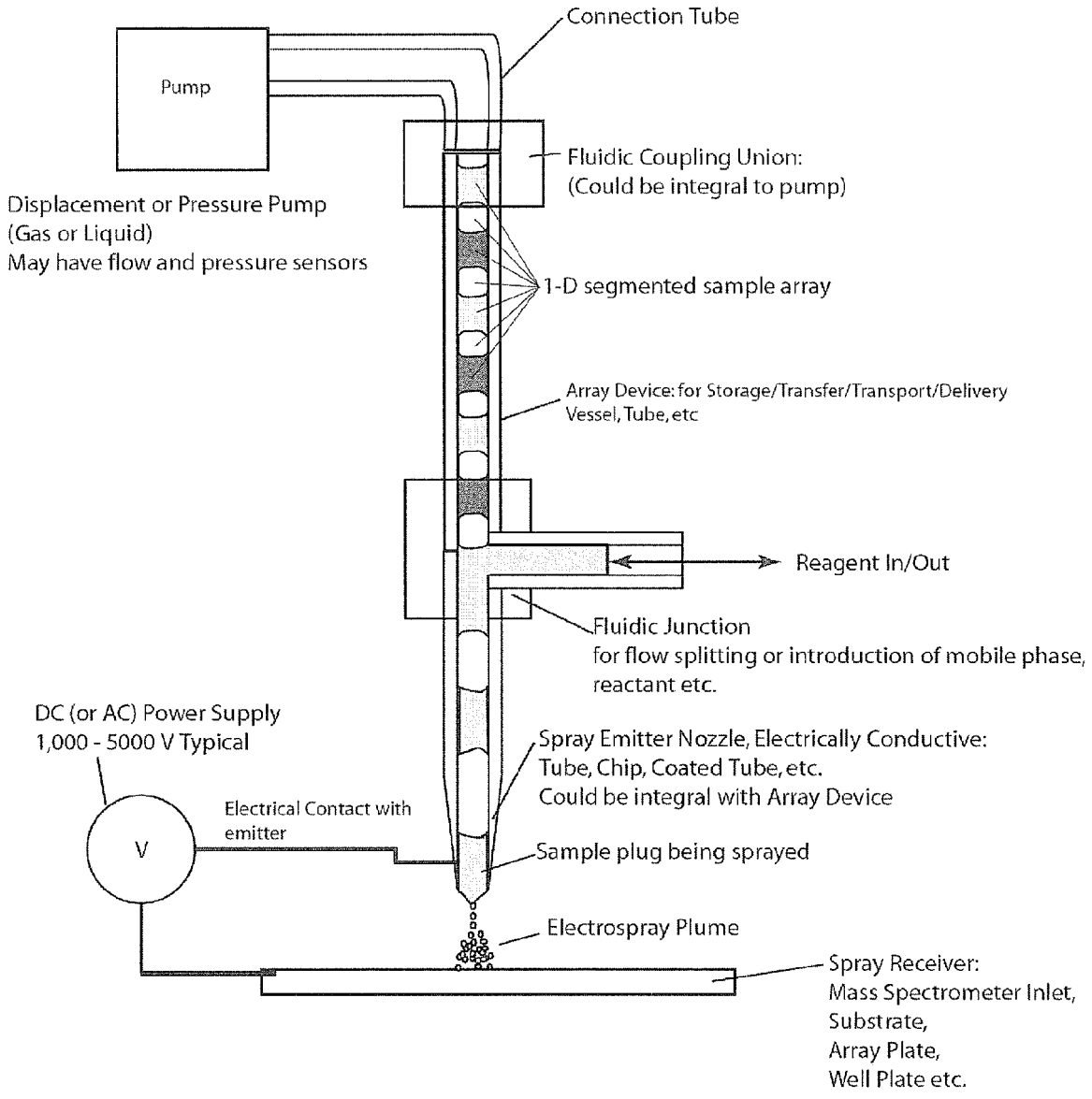

FIG. 6. Embodiment of system with mechanism for expanding, reducing, removing, or adding segments prior to the electrospray source. This system may be used to add reagents for chemical reactions or chemically modify plugs to make them more compatible with electrospray.

Figure 7:
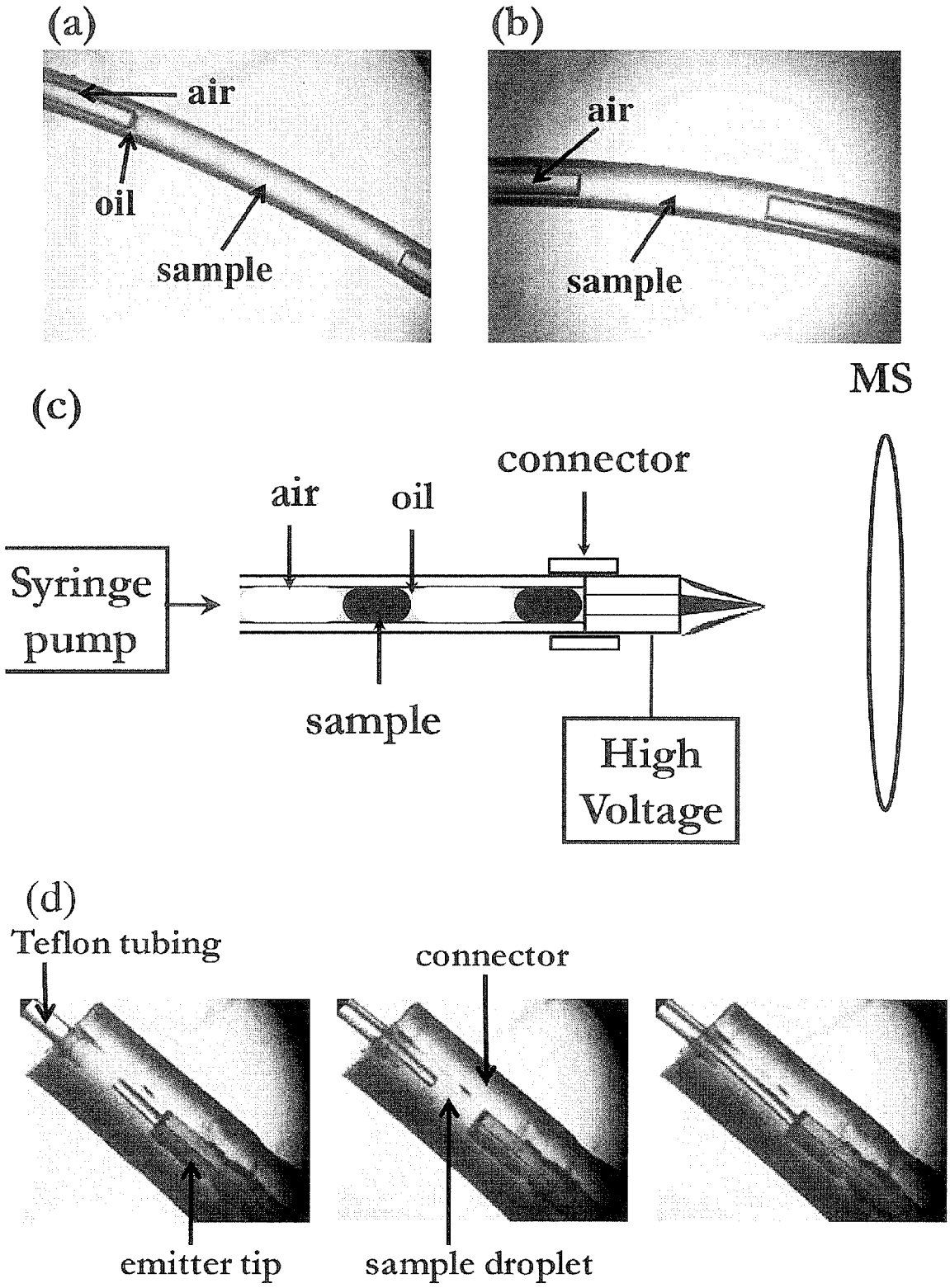

FIG. 7. (a) Photograph of a 3 mm long (50 nL) plug stored in a 150 μm i.d. Teflon™ tube. Plug was created by withdrawing sample and air alternately into the tube prefilled with Fluorinert FC-40. (b) Same as (a) except the tube was prefilled with air instead of oil. (c) Overview of scheme for analyzing a train of plugs stored in the Teflon™ tube. 2 kV is applied at the spray nozzle. Connector is a Teflon™ tube that fits snugly over the tube and emitter nozzle. (d) Transfer of plugs into electrospray emitter. Sequence of photographs showing a plug approaching emitter nozzle (left), entering (middle), and washing out (right) taken at 12 s intervals. Teflon™ tubing is 150 μm i.d., emitter capillary 50 μm i.d., and plugs 50 nL. Flow rate was 200 nL/min.

Figure 8:
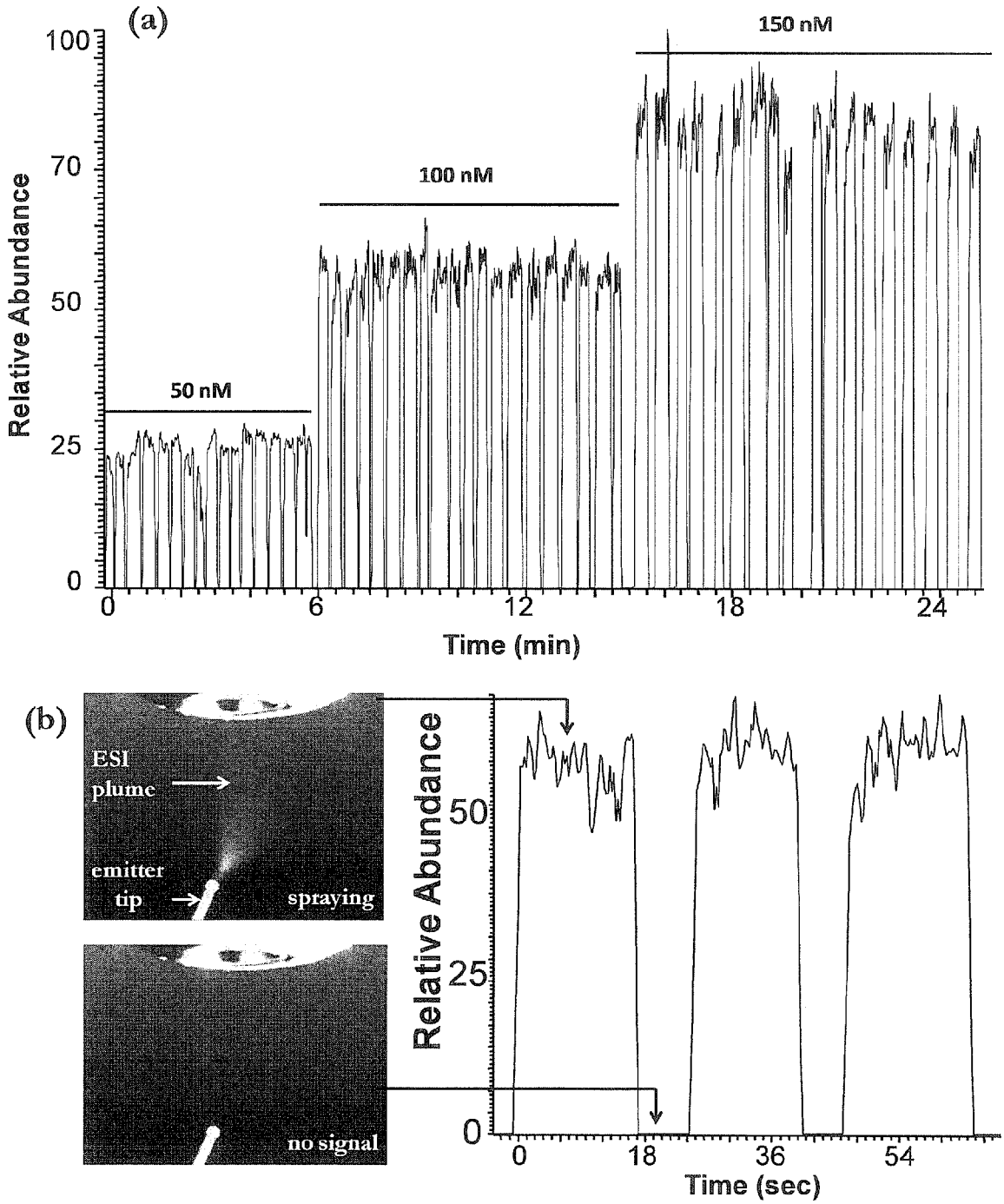

FIG. 8. (a) Extracted ion current for a series of 50 nL plugs with increasing concentrations of leu-enkephalin dissolved in 50% methanol, 1% acetic acid in water. Plugs were segmented with a 3 mm gap of air and pumped at 200 nL/min from a 150 μm i.d. Teflon™ tube. Ion signal is for $MS^3$ at 556→397→278, 323, 380 m/z. (b) Expanded view of extracted ion trace for 3 plugs of 100 nM leu-enkephalin from (a). Pictures to the left show the electrospray emitter nozzle when sample is emerging (top) and when air is emerging (bottom) and corresponding signals.

Figure 9:
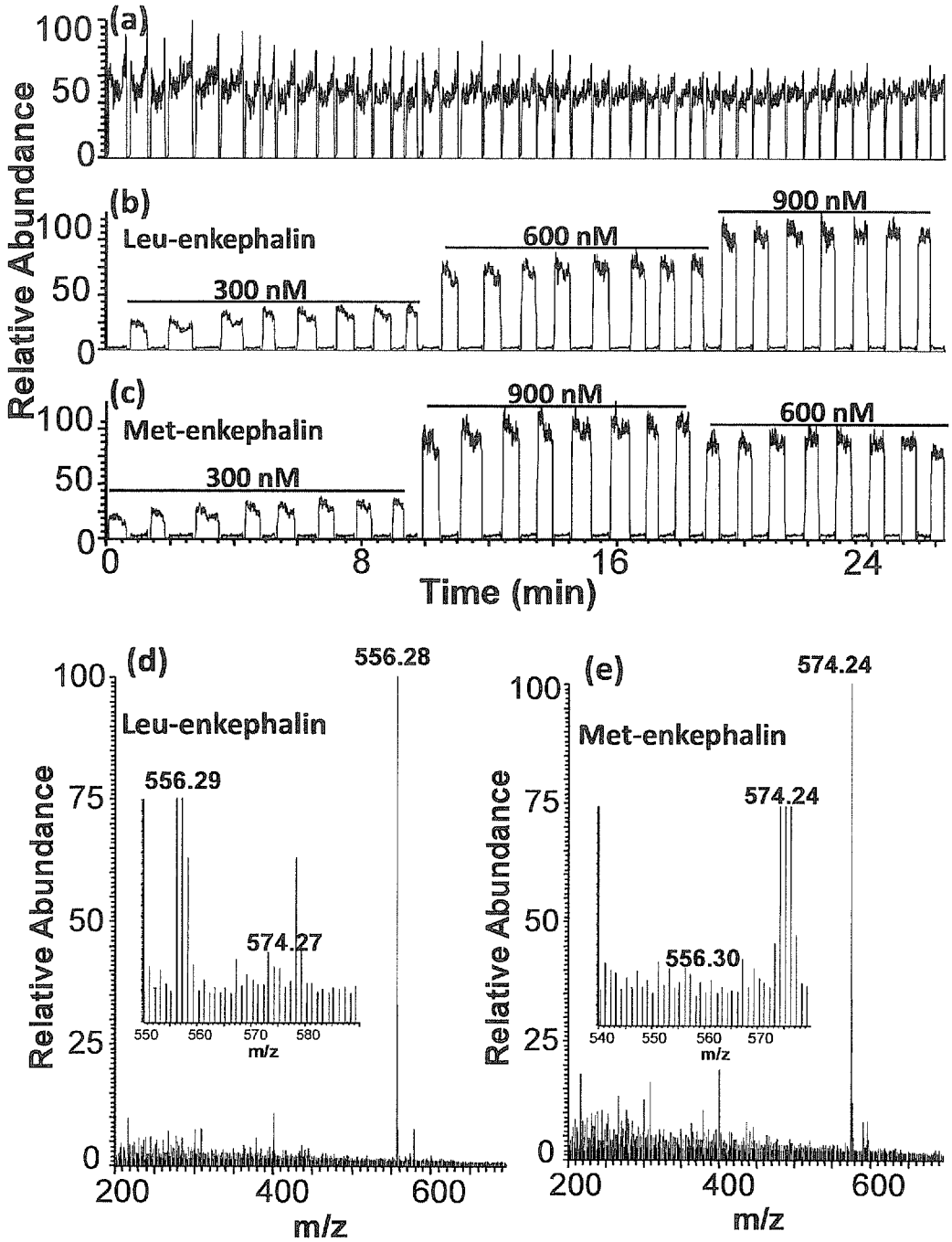

FIG. 9. Analysis of a series of plugs that alternately contain leu-enkephalin and met-enkephalin by single stage MS. Plugs were 100 nL with 5 mm gaps of air between them and pumped into the emitter at 200 nL/min. (a) Total ion current for entire sequence of plugs. (b) Extracted ion recording for leu-enkephalin at 556 m/z at concentrations indicated. (c) Extracted ion recording for met-enkephalin at 574 m/z at concentrations indicated. (d) Mass spectrum acquired during elution of a leu-enkphalin sample. Inset shows expanded view shows that signal for met-enekphalin (574 m/z) in this plug is slightly above the noise. (e) Mass spectrum acquired during elution of a met-enkphalin sample. Inset is an expanded view showing that the signal for leu-enekphalin (556 m/z) in this plug is not above the noise.

Figure 10:
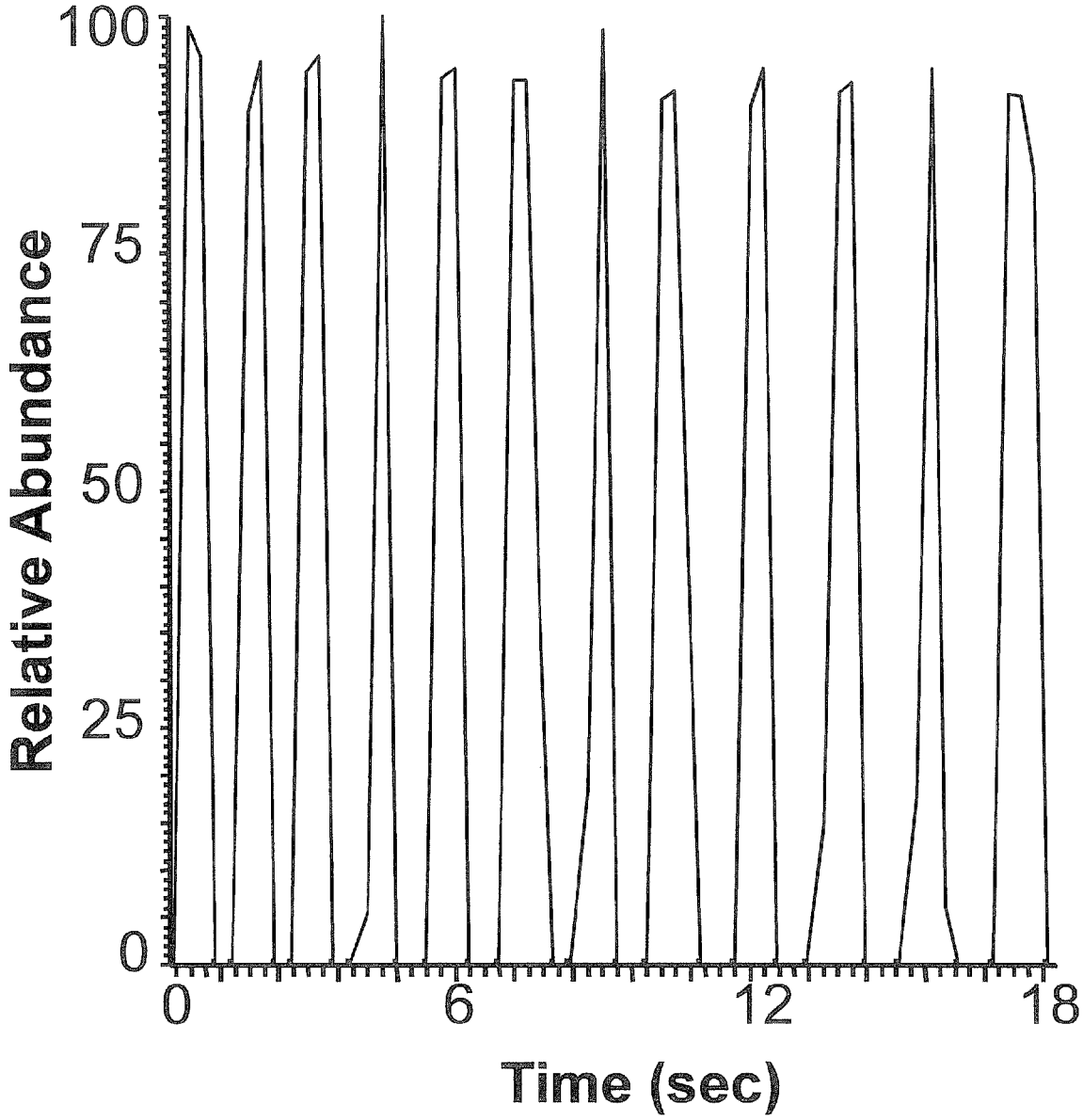

FIG. 10. High-throughput plug analysis. Extracted ion current for a series of 12 plugs of 200 nM leu-enkephalin in 50% methanol and 1% acetic acid samples. Each plug was 13 nL volume, separated by a 3 mm air gap, and pumped into the emitter at 600 nL/min. Ion signal is for $MS^3$ at 556→397→278, 323, 380 m/z.

Figure 11:
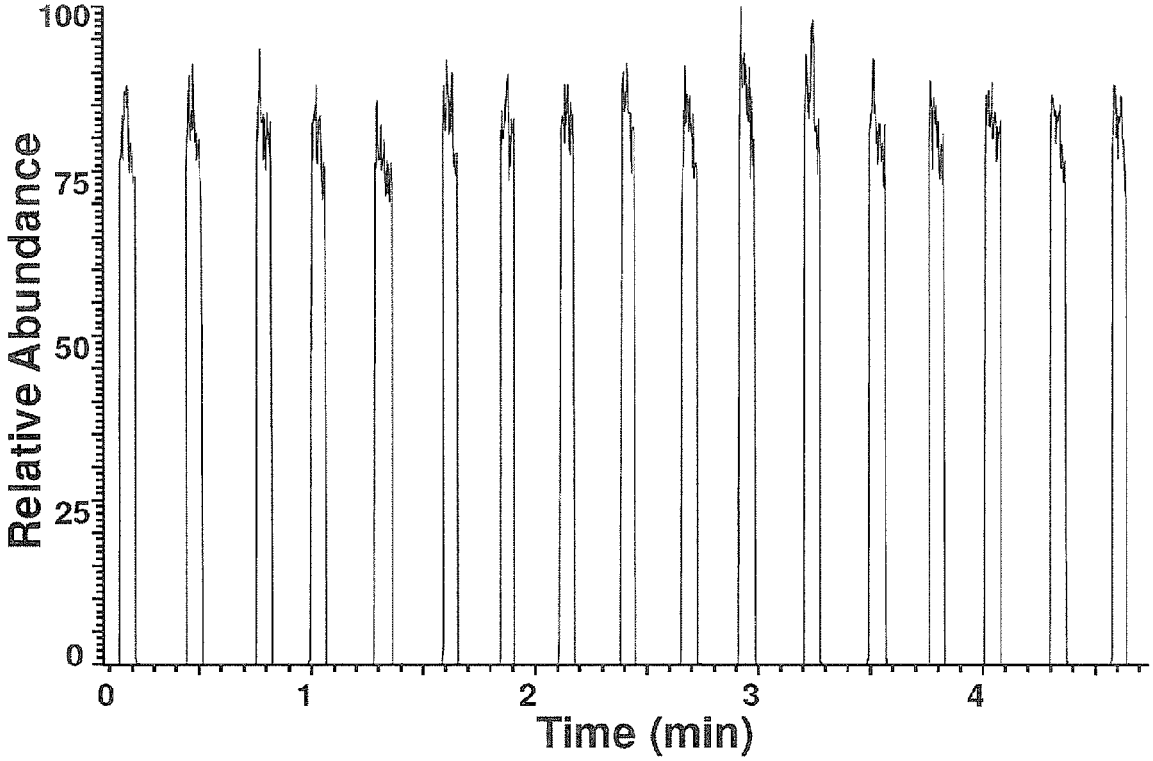

FIG. 11. leu-enkephalin droplets segmented by Fluorinert FC-77. The segmented flow was infused to ESI spray at 500 nL/min. spray voltage 2 kV was applied to the coated nozzle.

Figure 12:
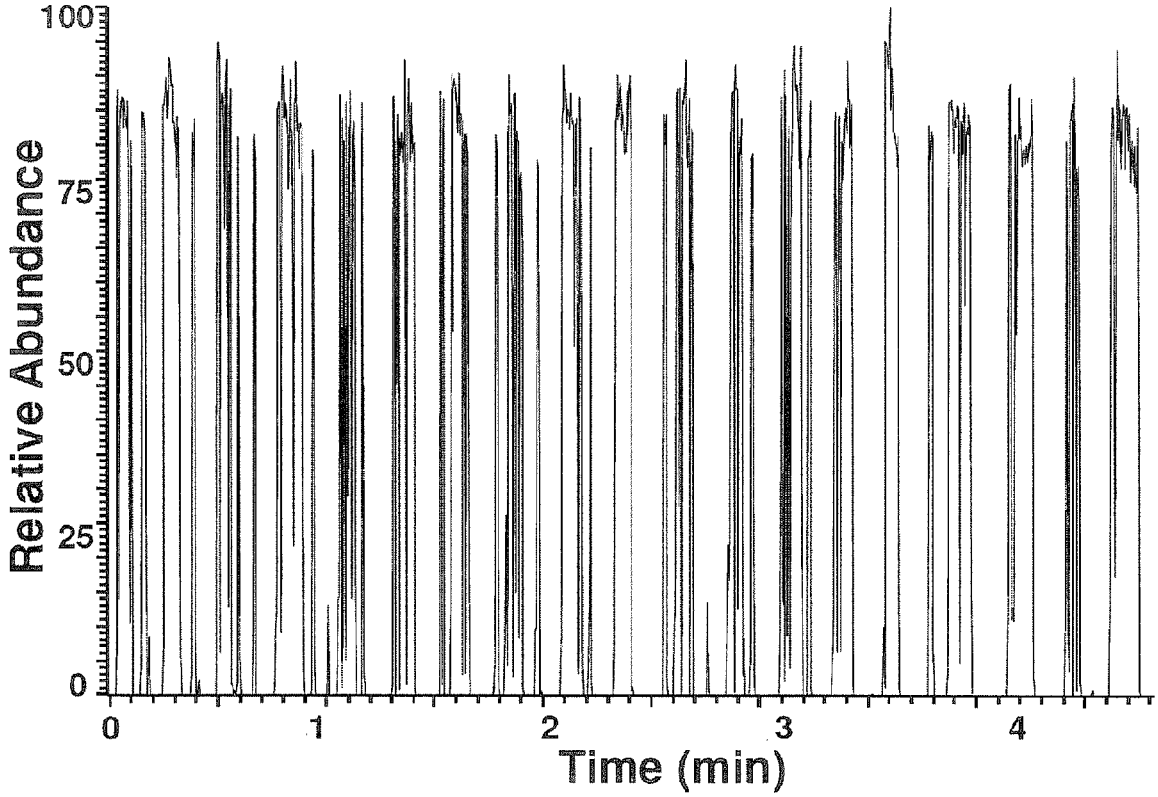

FIG. 12. leu-enkephalin droplets segmented by Fluorinert FC-40. The segmented flow was infused to ESI spray at 200 nL/min. spray voltage 2 kV was applied to the coated nozzle.

Figure 13:
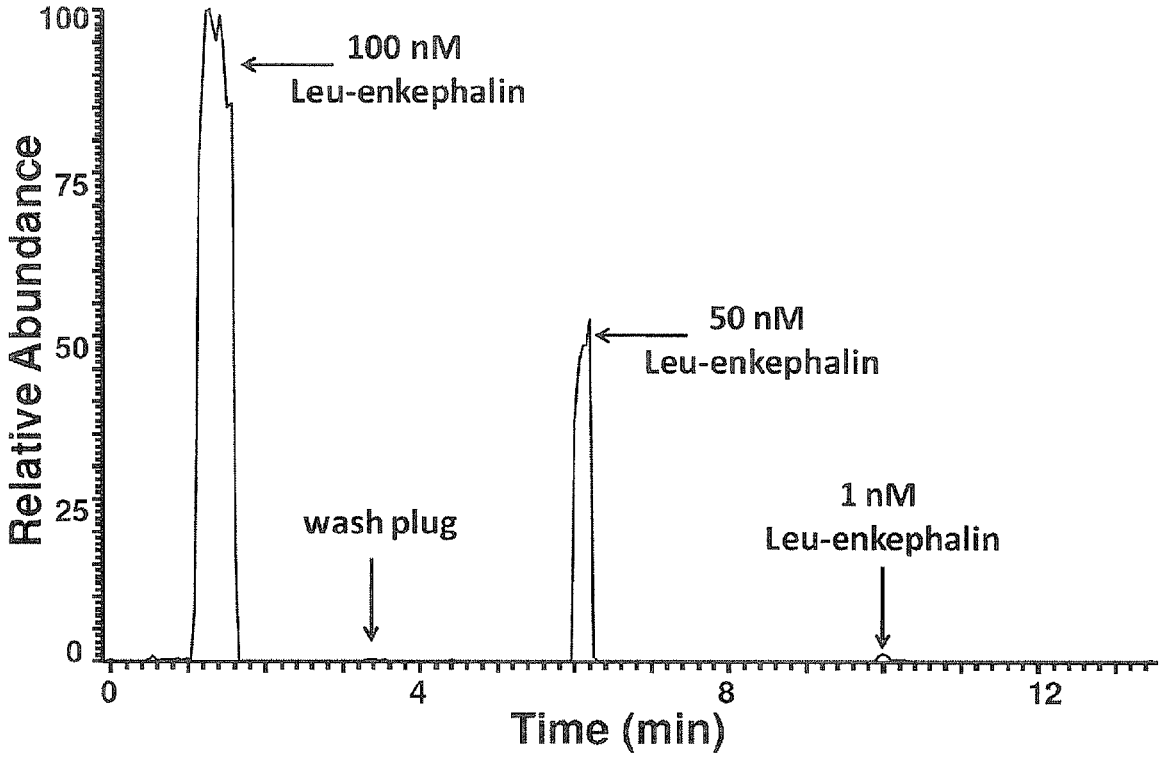

FIG. 13. 100 nM, 50 nM and 1 nM leu-enkephalin droplets segmented by air plugs. Each droplet was followed by a wash plug of the same size. The segmented flow was infused to ESI spray at 200 nL/min. and spray voltage 2 kV was applied to the coated nozzle.

Figure 14:
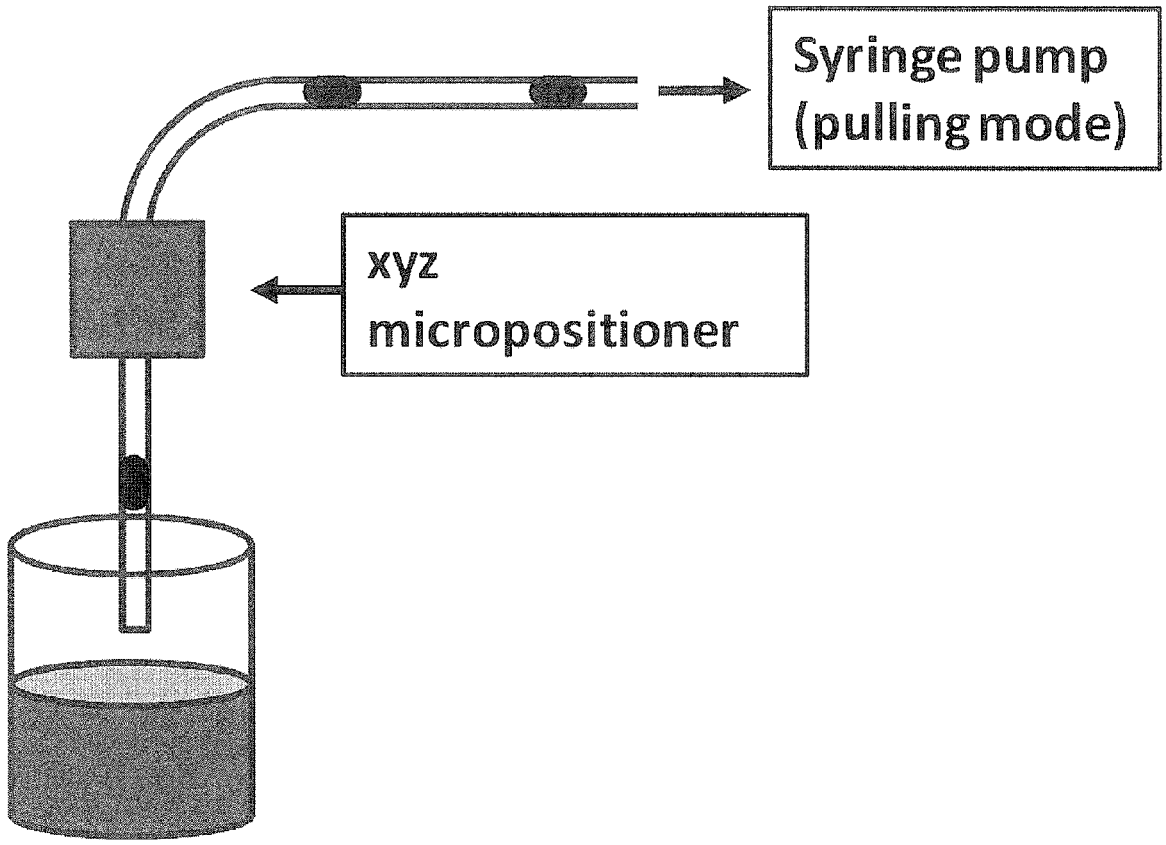

FIG. 14. A schematic of a micropositioner and syringe pump for drawing a liquid from a fluid source.

Figure 15:
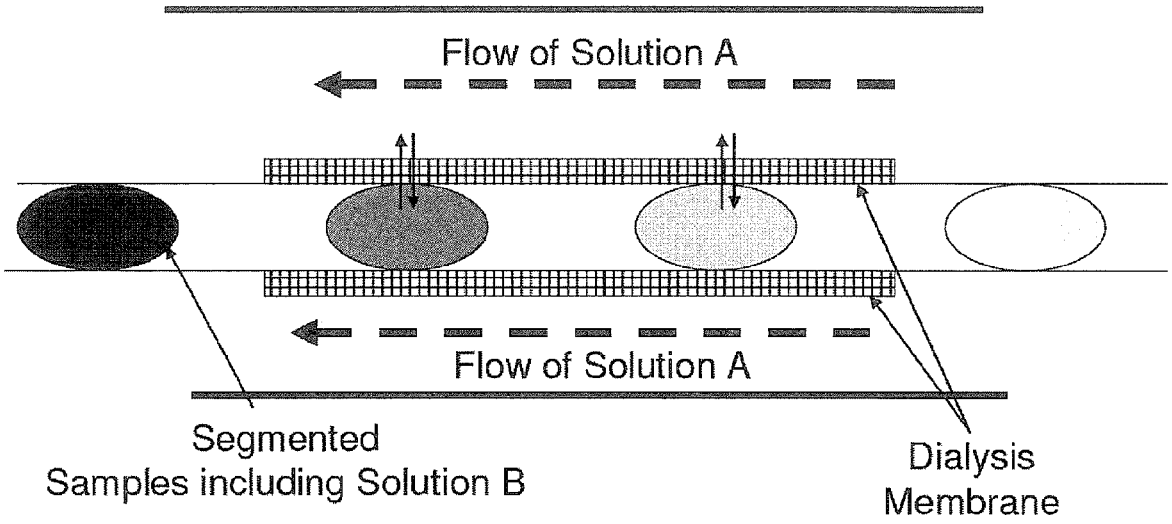

FIG. 15. Example of modified flow path for segmented flow that allows mobile phase fluid exchange. This may be used for desalting of samples or addition of reagents for chemical reactions.

Figure 16:
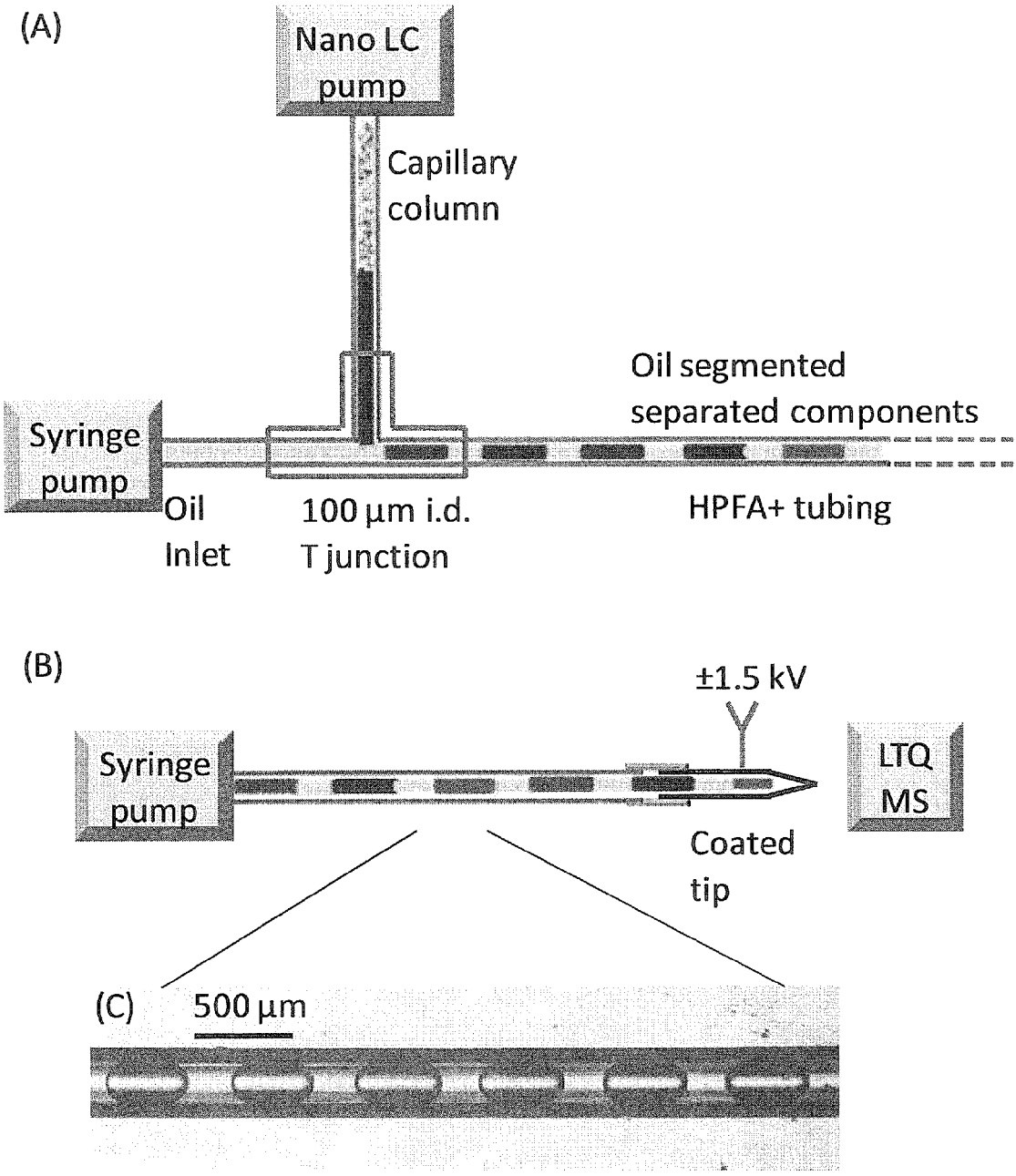

FIG. 16. Illustration of scheme for fraction collection from capillary LC and off-line ESI-MS using segmented flow. (A) Segmented flow was generated with a tee junction that connected an oil stream and effluent from capillary LC. (B) Oil-segmented fractions collected could be stored in HPFA+ tubing and then be infused into MS off-line by a syringe pump. (C) Picture of the oil-segmented flow in 150 μm i.d. tubing showing about 400 μm long sample plugs (LC fractions) separated by about 240 μm long oil plugs.

Figure 17:
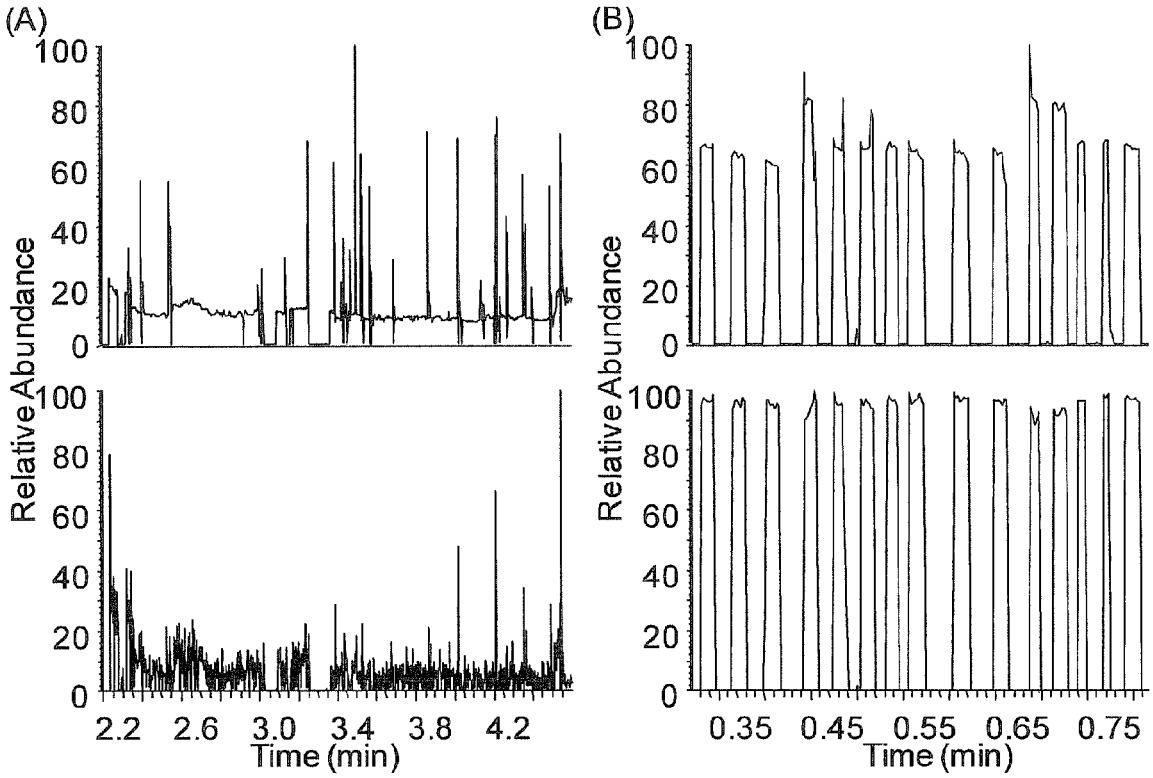

FIG. 17. (A) TIC (upper) and RIC (lower) of 50 μM cAMP (m/z=328) sample droplets infused at 200 nL/min with FC-72 as oil phase, showing noisy signal all over the chromatogram and little signal of samples. (B) TIC (upper) and RIC (lower) of the same cAMP sample droplets with PFD as oil phase, showing discrete segmented signals of cAMP sample plugs.

Figure 18:
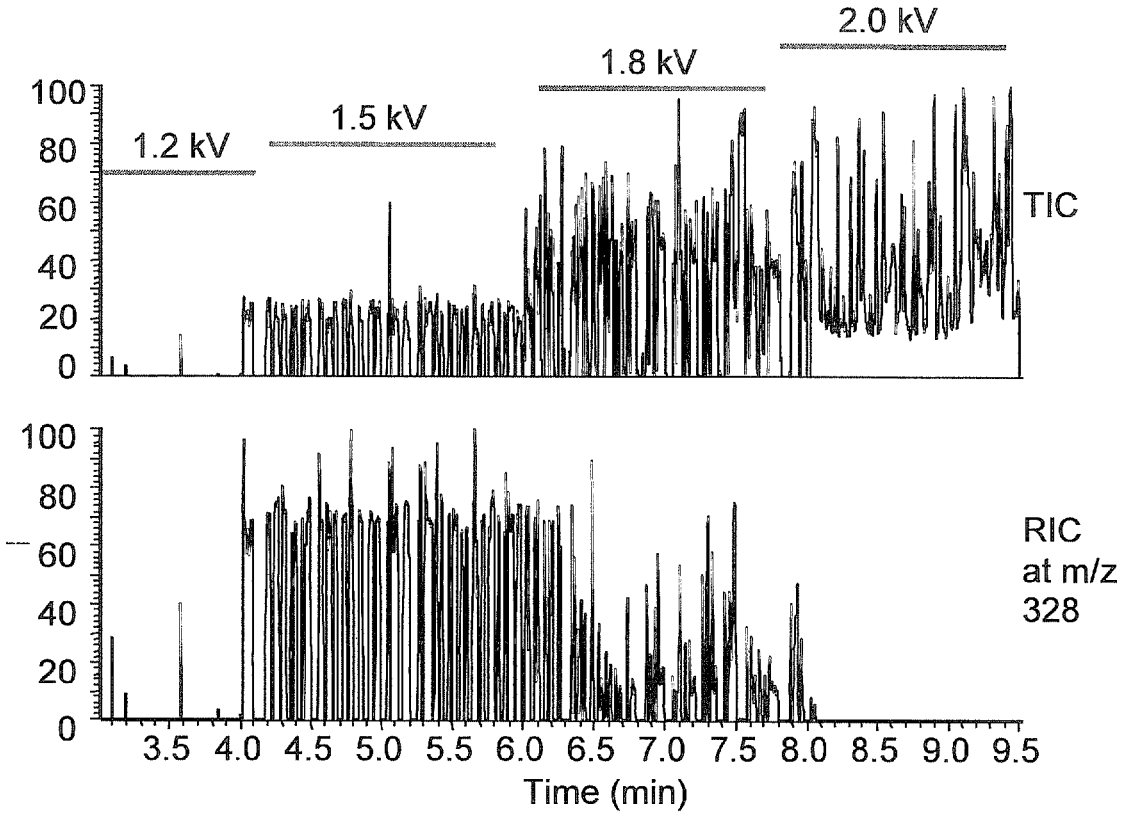

FIG. 18. (A) TIC (upper panel) and RIC (lower panel) of oil segmented droplets of 50 μM cAMP sample infused at 200 nL/min, with different spray voltage from 1.2 to 2.0 kV. (B) Oil coming at the nozzle at 1.5 kV that just dripped off the nozzle. (C) Oil underwent ESI at 2.0 kV. When the oil sprayed, the TIC signals were higher due to more signal of oil, but the RIC for aqueous samples were lower, which means the spray of oil interfered with the sample ions.

Figure 19:
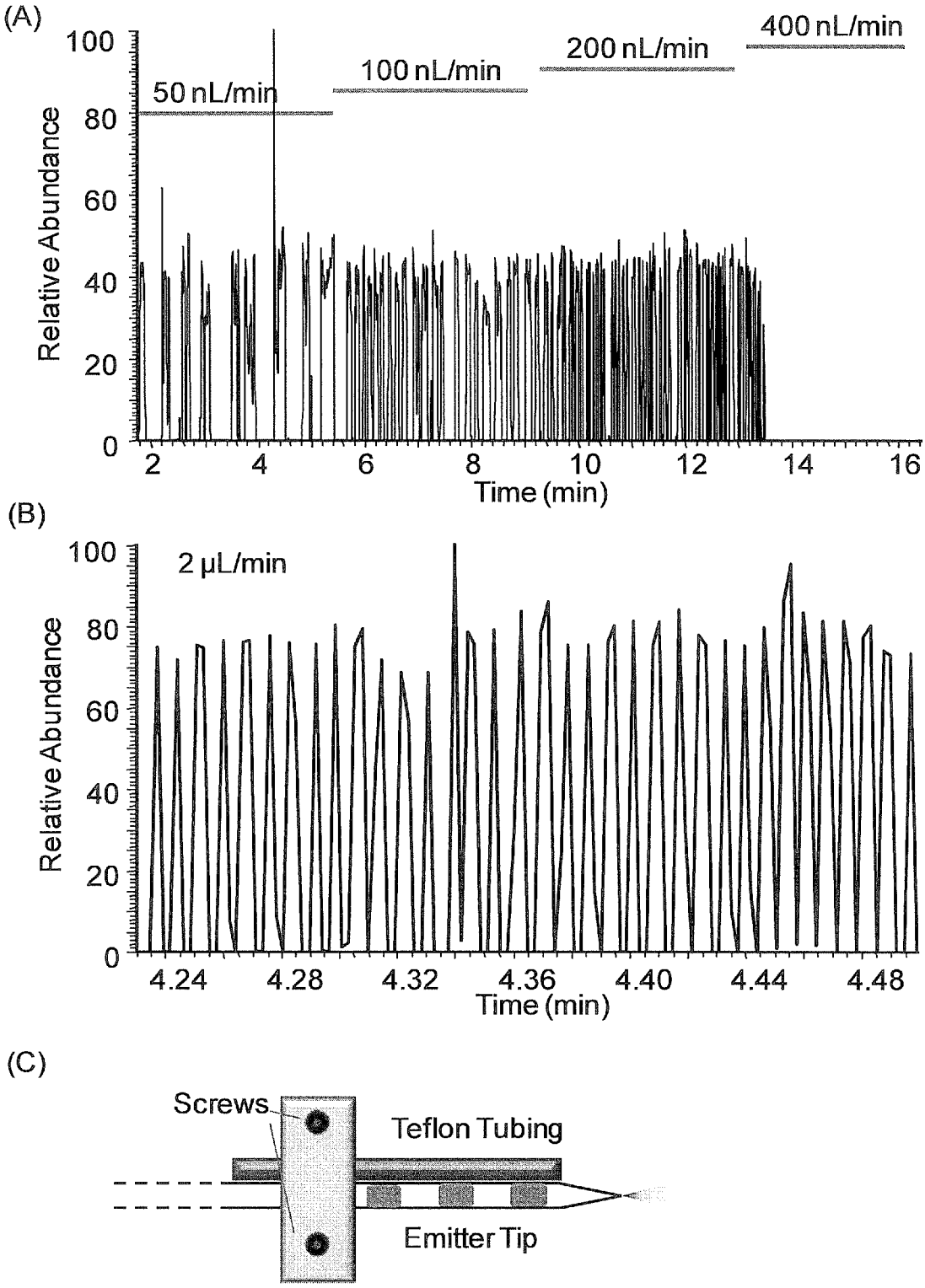

FIG. 19. (A) RIC of oil segmented droplets of 50 μM cAMP sample infused at different flow rate from 50 to 400 nL/min. At 400 nL/min, no signal was seen because oil accumulated at the emitter nozzle too fast to be removed so it blocked the voltage causing no signal. (B) RIC of oil segmented droplets infused at 2 μL/min. In this case, with a side Teflon™ tubing to extract oil out (shown in C), such high flow rate could be used and fast detection of droplet signal was achieved. This chromatogram showed detection of 35 droplets in 0.26 min, which is a frequency at about 2.2 Hz.

Figure 20:
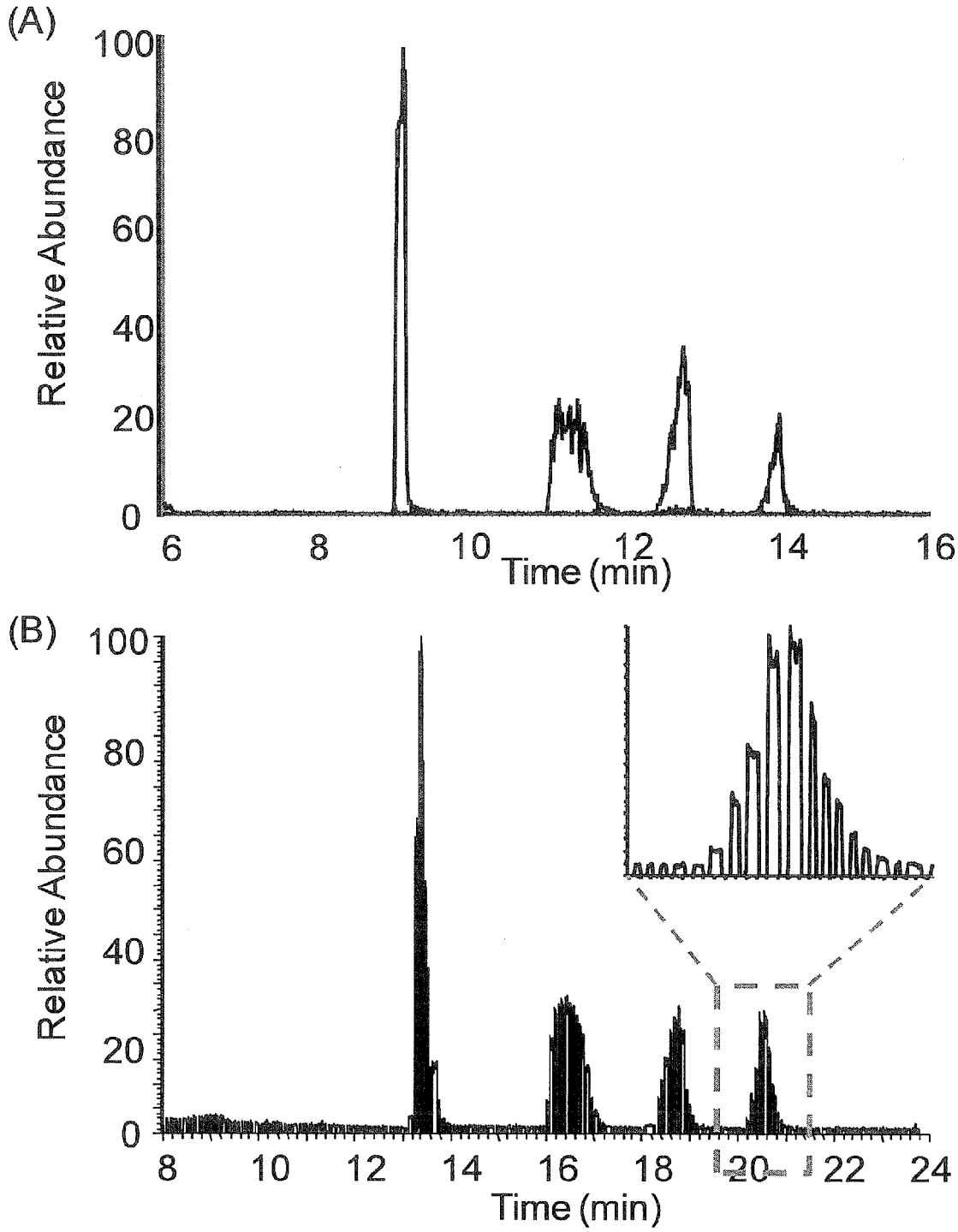

FIG. 20. Overlap of RICs for 4 metabolite components. (A) On-line detection of 4 sample on micromass QQQ MS, showing peaks of malate, citrate, PEP and F1,6P in a row. (B) Raw RICs of the 4 sample in droplet format obtained using the LIT MS. Using the same flow rate at 500 nL/min, it took 16 min to analyze 10 min of LC effluent because the oil in the final segmented flow accounts for ⅜ of total volume. A zoomed look of the detection of fractions over the F1,6P peak is shown.

Figure 21:
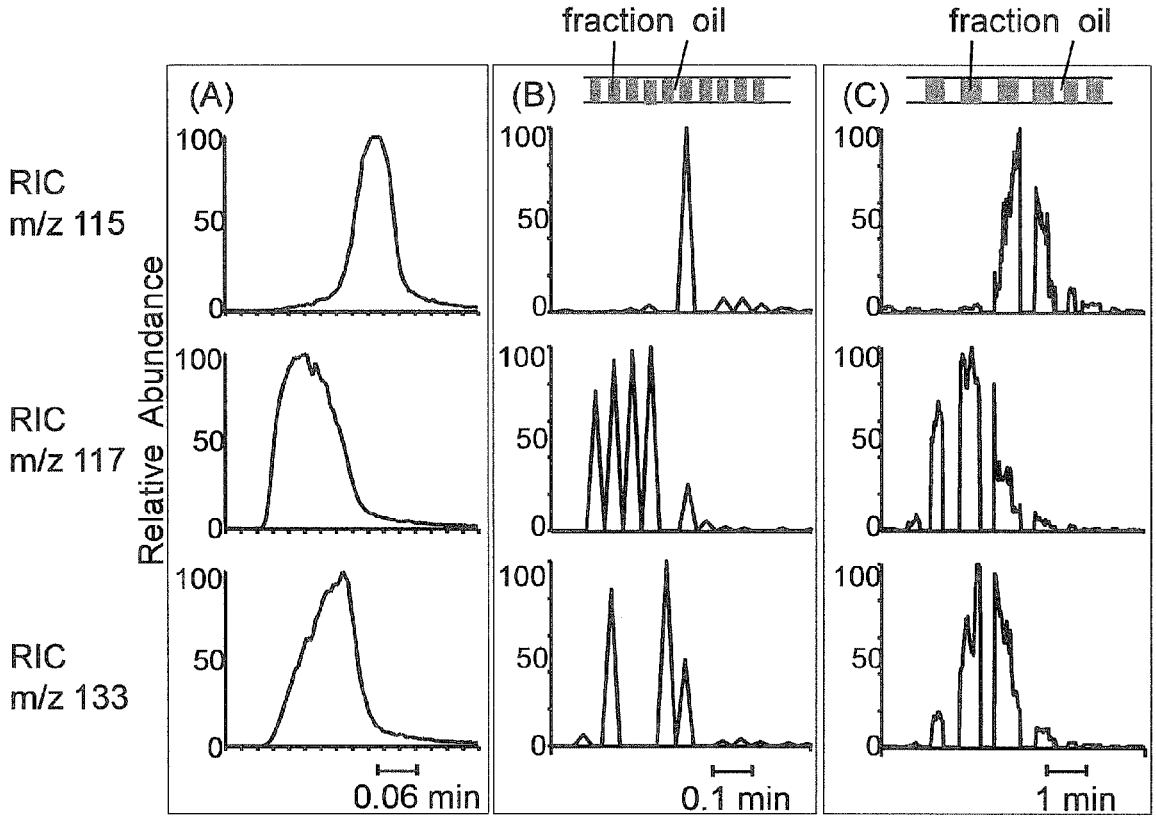

FIG. 21. Comparison of RICs of 3 co-eluting components fumarate (m/z 115), succinate (m/z 117), and malate (m/z 133) without and with peak parking. Different time scales for three groups of chromatograms were marked at the bottom of each figure. (A) On-line detection of the 3 compounds with QQQ-MS. (B) Off-line detection of the 3 compounds in segmented flow at 500 nL/min, the same flow rate as the original on-line detection. These peaks were narrow, resulting in only 1-5 scans covering each sample peak. Top figure showed rough sample droplets distribution. (C) Off-line detection of the 3 compounds in segmented flow by reducing flow rate to 50 nL/min right before the three peaks, resulting in more scan numbers over each sample peak.

Figure 22:
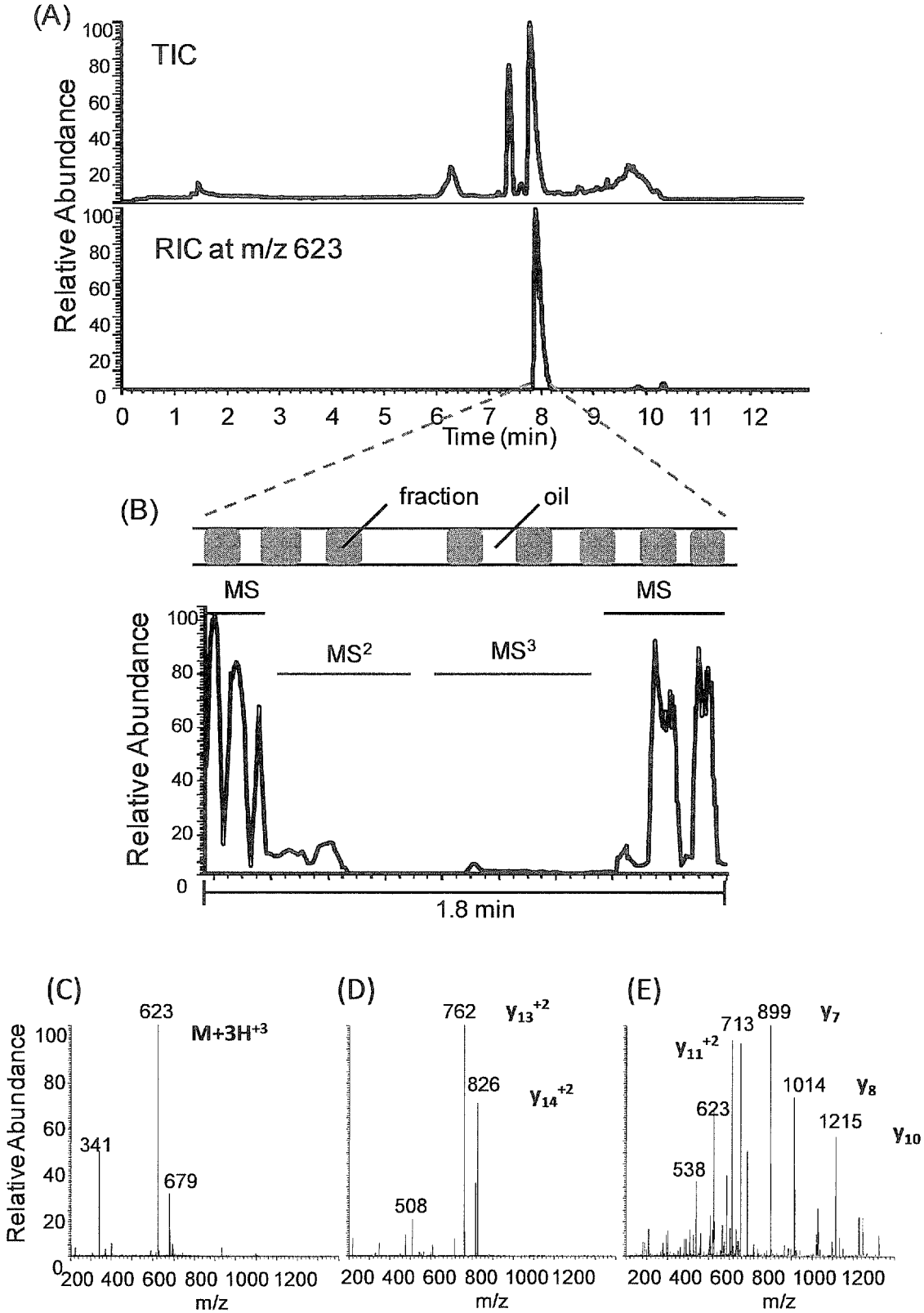

FIG. 22. (A) TIC and RIC of trypsin digested CRF. RIC showed the peak of the most abundant fragment peptide at m/z 623. (B) The expanded region of the TIC corresponding to the peak parking event initiated when first peak at m/z 623 was seen for MS detection of segmented flow of the separation. $MS^2$ and $MS^3$ analyses were performed manually by selecting the most abundant parent ion. Sample droplet distribution was indicated, which was uneven due to unstable perfusion flow rate at 25 nL/min generated by the syringe pump. TIC for $MS^2$ and $MS^3$ were lower compared to MS signal. (C), (D), and (E) show mass spectra corresponding to the MS, $MS^2$ and $MS^3$ event respectively in the peak parking region.

Figure 23:
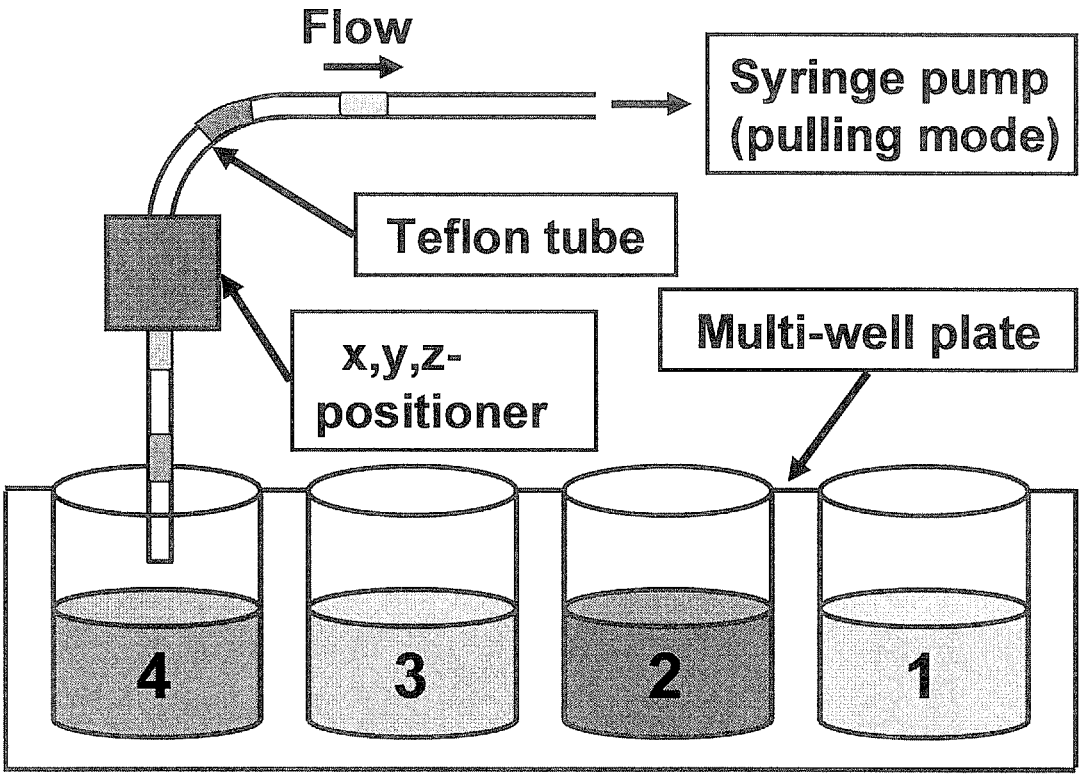

FIG. 23. Diagram of system for generating air-segmented sample plugs from a multi-well plate. Arrays of sample plugs were prepared by dipping the tip of a 75 μm i.d. Teflon™ tubing prefilled with Fluorinert FC-40 into sample solution stored in a multi-well plate, aspirating a desired volume, retrieving the tube, aspirating a desired volume of air, and moving to the next well until all samples were loaded. Movement of the tubing was controlled with an automated micropositioner and sample flow was controlled with a syringe pump connected to the opposite end of the tubing.

Figure 24:
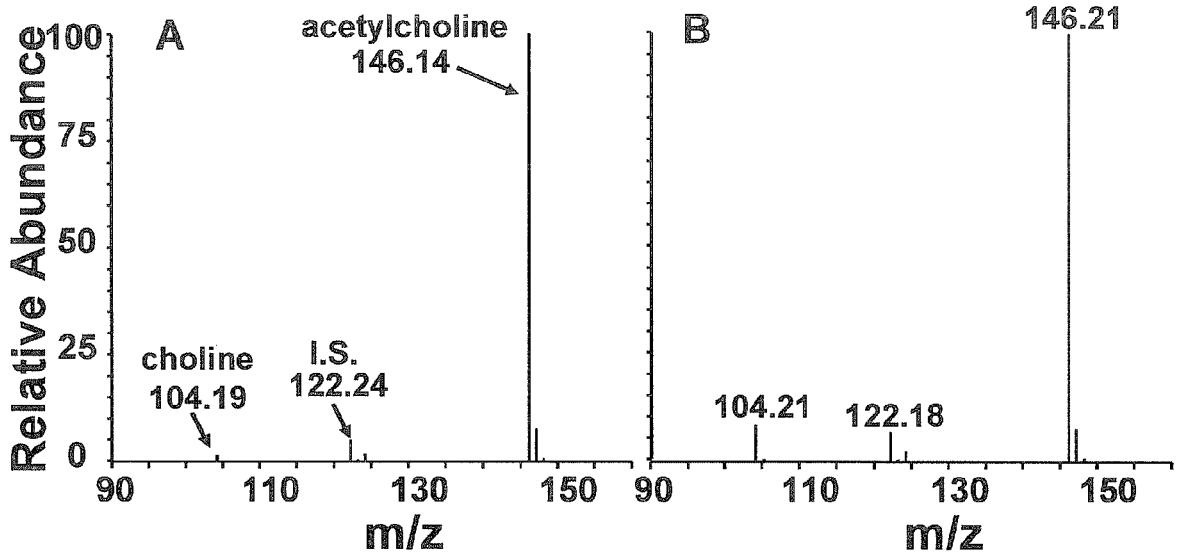

FIG. 24. ESI mass spectra of quenched AchE assay mixtures after incubating 100 mM acetylcholine, chlormequat (internal standard or I.S.), and 45 μg/mL AchE with (A) or without (B) 100 μM of the AchE inhibitor neostigmine at room temperature for 20 minutes. AchE inhibition is detected by decrease of choline signal relative to control without inhibitor.

Figure 25:
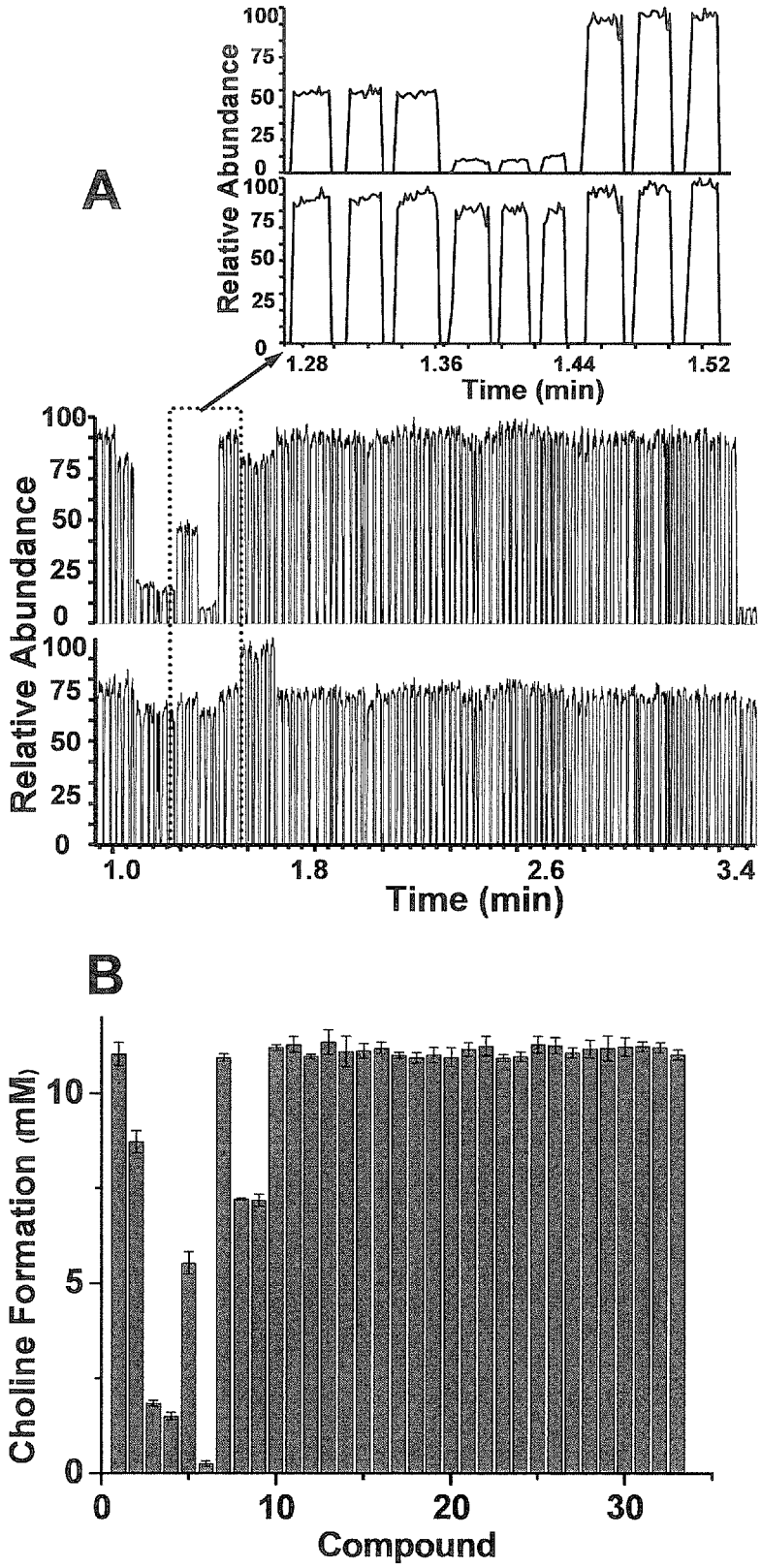

FIG. 25. Screening of AchE inhibitors by segmented flow-ESI-MS. (A) RIC trace for choline (top) and chlormequat (bottom) of 102 AchE enzyme assay sample plugs analyzed by ESI-MS. The series of samples tested 32 compounds for AchE inhibition plus two control samples, all in triplicate. Compounds tested were, from left to right, control 1 (no drug added), malathion, neostigmine, eserine, edrophonium, isoproterenol, yohimbine, UK14,304, DMSO, serine, adenosine, thyronine, GABA, phenylalanine, alanine, proline, arginine, cysteine, lysine, tyrosine, glycine, arginine, glutamine, methionine, leucine, tryptophan, isoleucine, histidine, glutamic acid, aspartic acid, taurine, dopamine, valine, control 2 (no enzyme added). Inset shows signal for two inhibitors and one inactive compound. (B) Quantification of choline formed in each sample determined by subtracting background formation of choline and comparing choline signal (ratioed to internal standard) to calibration curve. Bars show mean concentration from triplicate samples with ±1 standard deviation as error bar.

Figure 26:
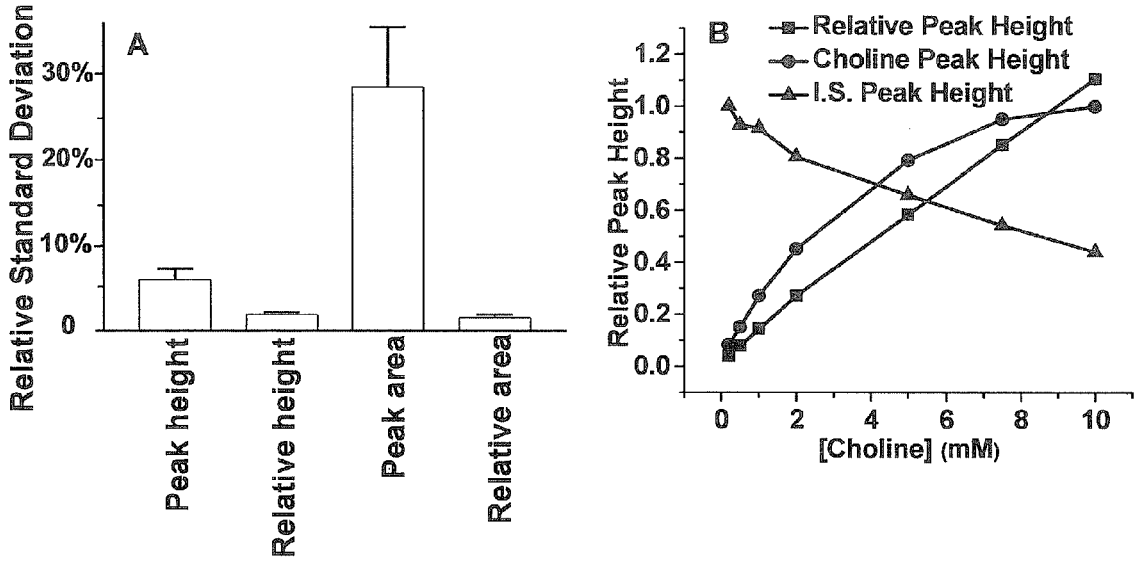

FIG. 26. Quantification of AchE hydrolysis. (A) Comparison of relative standard deviation for different methods of quantifying choline signal from RIC traces. Peak height is the highest choline ion intensity of all the scans over a sample plug; relative height is the ratio of peak height of choline to that of chlormequat; peak area is the area under all the MS scans of a sample plug; relative area is ratio of the peak area of choline to that of chlormequat. Error bars are ±1 standard deviation (n=7). The average RSDs were 5.9%, 28.5%, 1.9%, and 1.5% for calculation based on peak height, peak area, relative height, and relative area respectively; (B) Calibration curve for choline. Solutions containing 0.9 mM chlormequat and various concentrations of choline (200 μM to 10 mM) were infused for ESI-MS analysis. Choline peak intensity increased with its concentration non-linearly while chlormequat (I.S.) peak intensity decreased with higher choline concentration (Normalized peak intensities were used for both choline and chlormequat). Using ratio of the two peak heights (relative peak height) corrected the effect caused by charge competition during ESI so that the ratio increased linearly with choline concentration. The calibration curve based on relative peak height had slope of 0.11 $mM^{-1}$, y-intercept of 0.034, and $r^2$ of 0.999.

Figure 27:
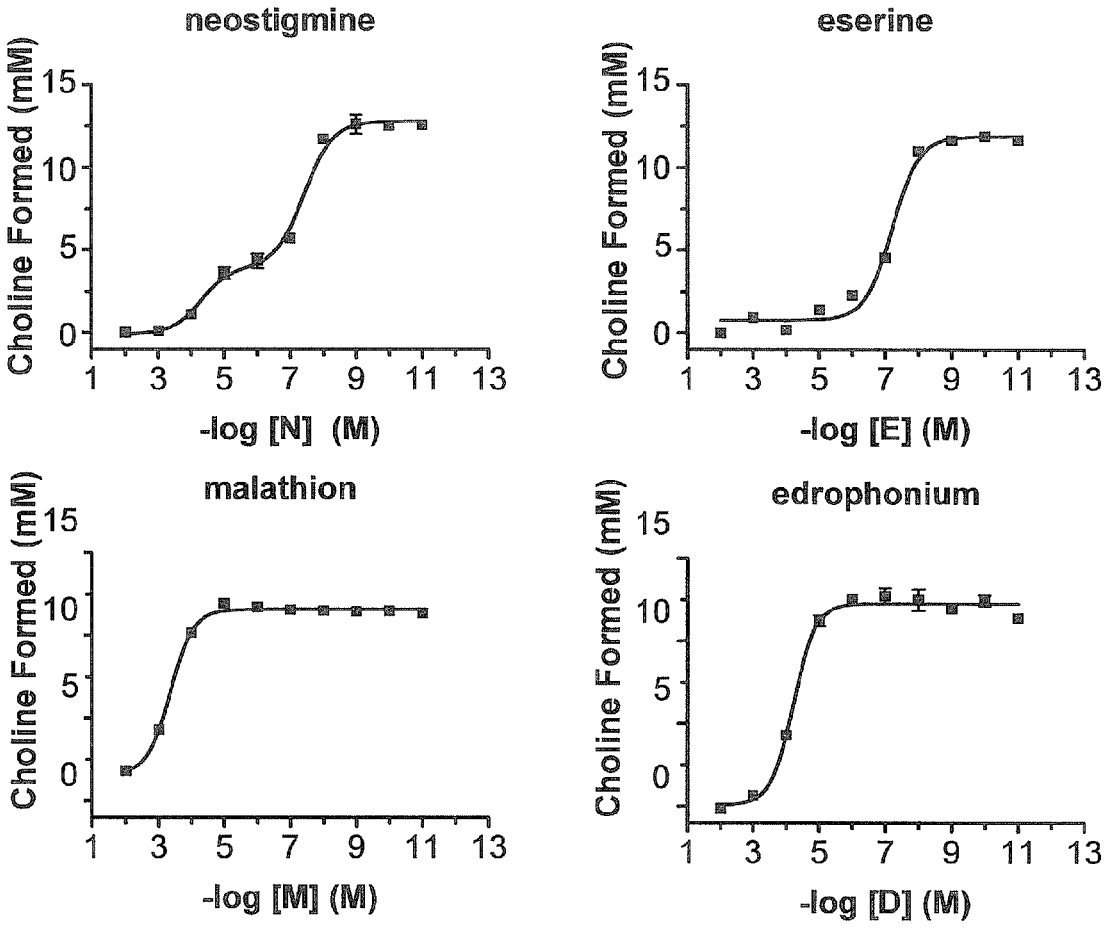

FIG. 27. Dose-response curves of four AchE inhibitors determined using segmented flow ESI-MS. Choline formation when incubated with various inhibitor concentrations were fit to sigmoidal dose-response curves except for neostigmine which was fit to a two-site competition curve. Error bars are ±1 standard deviation (n=3).

DETAILED DESCRIPTION

Example embodiments will now be described more fully with reference to the accompanying drawings. Example embodiments are provided so that this disclosure will be thorough, and will fully convey the scope to those who are skilled in the art. Numerous specific details are set forth such as examples of specific components, systems, and methods, to provide a thorough understanding of embodiments of the present disclosure. It will be apparent to those skilled in the art that specific details need not be employed, that example embodiments may be embodied in many different forms, and that neither should be construed to limit the scope of the disclosure.

Multiphase flow in capillary or microfluidic systems provides a way to partition and process many discrete samples or synthetic reactions in confined spaces. An example of such an arrangement is a one-dimensional segmented sample array, which can include a series of plugs or droplets separated by gas or immiscible liquid such that each plug can act as a small, individual vial or reaction vessel. The term segmented flow is used to refer to a system in which an array of plugs or droplets can be manipulated by flowing them within a tube or channel or other vessel that is suitable for maintaining the array. The array of sample plugs or droplets are within a first phase or medium and are separated by spacer plugs comprising a second phase or medium, also called a carrier phase, that may be gas or any immiscible or partially immiscible liquid. In some cases, the media and surface of the vessel may be of such composition as to minimize mixing or contact between the individual plugs of the array whereas in other cases the media and surface may allow contact of separate plugs or droplets; e.g., along the walls of the vessel.

Mass spectrometry (MS) is an attractive analytical technique for analysis of segmented flows because it has the sensitivity and speed to be practically useful for low volume samples analyzed at high-throughput. For example, MS has been coupled to segmented flow by collecting samples onto a plate for MALDI-MS or a moving belt interface for electron impact ionization-MS. ICP-MS of air-segmented samples has been demonstrated on a relatively large sample format (about 0.2 mL samples). MS analysis of acoustically levitated droplets using charge and matrix-assisted laser desorption/ionization has also been demonstrated.

In addition, one method to perform electrospray ionization (ESI)-MS of a stream of segmented flow has been developed. In this method, a stream of aqueous droplets segmented by immiscible oil was periodically sampled by using electrical pulses to subsequently transfer the droplet into an aqueous stream that was then directed to an electrospray source. That is, the sample plugs were transferred from a segmented array to an entirely aqueous stream prior to electrospray. This method showed the feasibility of on-line droplet analysis; however, the limit of detection (LOD) for peptide was about 500 μM. The high LOD was due at least in part to dilution of droplets once transferred to the aqueous stream and the high flow rate (about 3 μL/min) for the electrosprayed solution. The dispersion of droplets after transfer to the aqueous stream also limited the throughput of this approach.

According to the principles of the present technology, it has been found that a series of sample plugs (e.g., about 1 nL to about 50 nL) segmented by spacer plugs (e.g, gas or immiscible fluid) can be pumped directly into a low flow rate electrospray source to yield a simple, robust, and sensitive method for analyzing droplet content; for example, as illustrated in FIGS. 1 and 7. The present systems and methods can be considered a novel approach to sample introduction for MS, where a one-dimensional segmented sample array is directly coupled to an electrospray ionization emitter nozzle and individual sample plugs are positioned to enter the nozzle for electrospray.

In the present systems and methods, the one-dimensional segmented sample array is directly coupled to the electrospray ionization emitter nozzle. By "direct coupling," we refer to positioning, pumping or flowing the segmented array of plugs at or through the electrospray emitter and out of the nozzle such that segmented flow is maintained at entry to the nozzle, and within and through the nozzle. For example, direct coupling of the one-dimensional segmented sample array to the electrospray ionization emitter tip precludes transfer and coalescing of the sample plugs in a new medium prior to advancing the array to the electrospray ionization emitter tip. Direct coupling between the one-dimensional segmented sample array and the electrospray ionization emitter nozzle is therefore unlike other processes that transfer sample plugs to an aqueous stream prior to electrospray of the samples. That is, direct coupling does not permit the sample plugs in the segmented array to be "de-segmented" prior to entering the electrospray ionization emitter nozzle and being electrosprayed. Direct coupling likewise precludes removing the spacer plugs prior to advancing the array through the electrospray ionization emitter tip. For example, FIGS. 1(*a*) and 1(*b*) show a one-dimensional segmented sample array positioned at the entry and/or within the electrospray ionization emitter nozzle; i.e, segmentation of the plugs is maintained up to and through the nozzle.

Moreover, the present technology allows for electro spraying of sample plugs segmented by spacer plugs that include a hydrophobic or oil-based medium. This is in contrast to work by others indicating that it is necessary to remove desired sample segments or droplets from the segmented flow and transfer them to a single phase flow prior to entering the electrospray emitter and nozzle. This was done by others because "[t]he direct MS analysis of microdroplets is problematic for several reasons. The primary difficulty stems from the presence of the carrier fluid, which is often composed of fluorous or mineral oils as well as significant amounts of surfactant. This continuous phase interferes with the ESI process by both sequestering charge carriers and preventing the formation of a stable Taylor cone." (quoted from "Coupling Microdroplet Microreactors with Mass Spectrometry: Reading the Contents of Single Droplets Online," Luis M. Fidalgo, Graeme Whyte, Brandon T. Ruotolo, Justin L. P. Benesch, Florian Stengel, Chris Abell, Carol V. Robinson, and Wilhelm T. S. Huck; Angewandte Chemie, 2009, 48, 3665-3668.). Thus, the present systems and methods allow for systems and methods that were not thought to be technically feasible or even possible.

Particular experiments are now described in order to more thoroughly illustrate the present technology. Linear (one-dimensional) arrays of sample plugs were prepared by dipping the tip of a 75 or 150 μm i.d. by 80 cm long polytetrafluoroethylene (PTFE) (e.g., Teflon™) tube filled with oil (Fluorinert FC-40) into sample solution stored in a 96-well plate, withdrawing a desired volume into the tube, removing the tube from the well, withdrawing a desired volume of air, and repeating until all samples had been loaded into the tube (e.g., as illustrated in FIG. 14). Used and constructed in this manner, the tube becomes an effective device for the handling, storage, transport, and delivery of the one-dimensional segmented sample array. Movement of the tubing was controlled with a custom-built, automated micropositioner and sample flow was controlled with a syringe pump connected to the opposite end of the tubing. Resulting plugs had a small amount of oil covering their ends and a convex meniscus indicating little wetting of the walls (FIG. 7A). Interestingly, loading the tube without a pre-fill of oil resulted in a flatter meniscus (FIG. 7B).

To interface to the mass spectrometer (LTQ XL, Thermo Fisher Scientific, Waltham, Mass.), the outlet of the tube was coupled to a Pt-coated fused-silica electrospray emitter nozzle (FS 360-50-8-CE, New Objective, Woburn, Mass.) which was 50 μm i.d. and pulled to 8 μm i.d. at the tip. The emitter nozzle was mounted in a nanospray source (PV-550, New Objective) (FIG. 7C). The plugs could then be pumped directly into the emitter nozzle for analysis.

The present systems and methods are not geometry or material specific to the emitter type. For example, other styles of electrospray ionization emitter nozzles known to those skilled in the art such as metal emitters, planar chip emitters, etc. could be used to generate the spray in addition to the metal coated fused silica emitters used herein. Furthermore, the result is not geometry or material specific to the vessel, tube, or container for the linear array of segments. For example, tubes of other materials than Teflon™ and channels of different inner diameters may be used. Planar, microfabricated channels may be used with different dimensions and flow rates. Various microfluidic devices, commonly referred to as lab-on-a-chip devices, may be used to form, store, and manipulate one or more one-dimensional segmented sample arrays. Also, the results are not dependent upon the method used to form the segmented array.

The pumping means used for directing and manipulating the one-dimensional segmented sample array may be any suitable method for generating the desired flow rate including use of mechanical devices such as syringe pumps, reciprocating piston pumps, or peristaltic pumps; gas-pressure; electroosmosis, or gravity. The flow rates may be any that generate electrospray. We have found that flow rates including from about 2 nL/min to about 20 μL/min are compatible with this approach. Flow rate may be chosen to achieve certain results and maximize advantages. For example, low flow rates serve to conserve sample and achieve advantages of nanospray while higher flow rates may be used for improved sample throughput.

When segmented samples were pumped into the directly coupled electrospray ionization emitter nozzle, sample plugs were transferred from the Teflon™ tubing to the emitter nozzle (e.g., FIG. 7D) and emerged from the outlet with no coalescence of back-to-back plugs resulting in pulses of electrospray plumes, electrospray current, and ion signal (e.g., FIG. 8). Electrospray current fluctuated between 0.0±0.2 μAmp and 1.2±0.2 μAmp as air and sample plugs alternately filled the tips. Electrospray signal rapidly stabilized as each new plug entered the emitter so that a series of plugs could be analyzed by continually pumping the segmented samples into the emitter (e.g., FIG. 8*b*). FIG. 8*a* illustrates the extracted ion current for a series of plugs containing leu-enkephalin, at progressively higher concentration, that were pumped into the emitter nozzle at 200 nL/min resulting in samples detected at 25 s intervals. For a series of plugs at 100 nM leu-enkephalin, signal RSDs were about 3.1% (n=20). The LOD for leu-enkephalin detected by MS3 was about 1 nM. This detection limit is a substantial improvement over previous ESI-MS analysis of droplet streams. The improved LOD is due in part to the system allowing direct injection of the plugs without dilution, which can occur when sample plugs are transferred to an aqueous stream, and compatibility with lower flow rates that improve ionization efficiency.

Carry-over between plugs was evaluated by preparing segmented sample arrays with different concentrations of leu-enkephalin and separating them by plugs containing only solvent. Based on this experiment, carry-over was observed at <1% for a 500 nM solution followed by blank and <0.1% for a 100 nM solution. If the tube was not pre-filled with oil, the carry-over was about 4% at 500 nM. The low carry-over allows different samples to be entered for back-to-back for analysis, as illustrated by FIG. 9, which shows extracted ion chromatograms and mass spectra from a series of plugs that alternately contained leu-enkephalin and met-enkephalin at different concentrations. Low cross-contamination is demonstrated by the lack of signal for met-enkepahlin in leu-enkephalin plugs and vice versa (e.g., FIGS. 9*b, c*, and *d*). Further reduction of carry-over may be possible by chemically modifying (e.g., coating) the interior of the emitter nozzle, such as with fluorinated alkanes.

For most experiments, some variation in the time between sample peaks was observed. This variation is mainly due to differences in the length of gaps formed during creation of the sample array. More sophisticated methods of creating plugs may reduce or eliminate this effect. The result is not limited to the method of plug formation used here.

Throughput for sample analysis can be varied by altering the droplet size, air-gap between plugs, and flow rate. By decreasing the capillary diameter to 75 μm, it was possible to create 13 nL plugs (3 mm long) separated by 3 mm long air gaps. Pumping this array of samples into the emitter at 600 nL/min resulted in analysis of a sequence of plugs at 0.8 Hz with a relative standard deviation (RSD) of 2.8% (see FIG. 10, for example). 50 samples contained in a 30 cm long tube were analyzed in 1.25 min using this approach.

It may be possible to further increase the flow rate or reduce the capillary diameter and plug volume to generate higher density of samples and higher-throughput. Further increases in throughput would require a mass spectrometer that could record spectra fast enough to keep pace with sample introduction. In this experiment, the mass spectrometer was operated in MS3 mode and 0.33 s was required to collect a spectrum. Therefore, only 3-4 spectra were collected across the signal peaks that were 1.2 s wide. Conversely, the flow rate could be varied to stop- or ultra low-flow (<10 nL/min) conditions as each sample plug elutes from the emitter, to allow $MS^n$ experiments on multiple masses and to take further advantage of the nanoelectrospray benefits of ionization efficiency and equimolar response. Therefore, the result is not dependent upon flow rate and the system may be used with variable flow rates to achieve goals of different applications.

In some cases, it was determined that similar results could be obtained by directly infusing samples segregated by oil or sample trains that had air-oil-air-sample sequences. In these embodiments, the oil can also be sprayed from the emitter nozzle (see FIGS. 11 and 12 as examples). However, in some embodiments, the oil is not sprayed and can be removed or drawn off the emitter nozzle to clear the nozzle for electrospray of the subsequent sample plug. For example, the electrospray conditions can be set such a spacer plug of oil forms a droplet at the emitter nozzle and is not electroprayed whereas an aqueous phase sample plug is electrosprayed. Changing the electrospray voltage is one way to set the electrospray conditions to spray aqueous sample plugs and not spray oil-based spacer plugs.

There are several ways to remove a droplet of oil on the emitter nozzle that is not to be electrosprayed. For example, the electrospray ionization emitter nozzle can be provided with an integral fluid removal tube or channel, such as a coaxial tube or channel, which is separate from the channel that delivers sample material to the nozzle. The tube or channel can be used to siphon off the oil droplet at the emitter nozzle so the next sample plug can be electrosprayed from the emitter nozzle. A separate integral fluid removal tube or channel provided to the emitter nozzle can also provide a capillary wicking action to remove a droplet or the application of vacuum through the tube or channel can remove excess fluid from the nozzle.

In particular, the electrospray ionization emitter nozzle can be provided with an integral fluid removal tube or channel, which is separate from the channel or tube through which sample fluids are supplied to the nozzle, as described by U.S. Pat. No. 6,690,006 to Valaskovic. This fluid removal tube or channel can provide capillary wicking or active vacuum suction to remove excess fluid from the nozzle. The action of the fluid removal tube or channel can be switchable between being active (on) or inactive (off). Thus, when a nozzle is brought below the electrospray threshold voltage, the action of the fluid removal channel can be turned on to remove any fluid that remains in or continues to flow through that nozzle. By doing this, such remaining fluid is prevented from accumulating at the tip of the "off" nozzle. This, in turn, minimizes or eliminates difficulties caused by excess fluid, such as oil from a spacer plug, which can accumulate at the nozzle end. Various suitable ways to remove a droplet from the emitter nozzle, such as an oil-based spacer plug, are depicted in FIGS. 2-5 of U.S. Pat. No. 6,690,006 to Valaskovic. These include nozzles having a coaxial tube arrangement where the outer tube is used to draw off the droplet by vacuum and the segmented array is advanced through the inner tube; a parallel, multi-lumen arrangement, with an equal lumen design for each function; a parallel, multi-lumen arrangement with an unequal lumen design; and a capillary wicking design that includes a capillary wicking rod, for example, to draw off a droplet that forms at the emitter tip. Another example is provided in FIG. 19 (C), where a Teflon™ tube is positioned alongside the nozzle and is used to extract oil droplets from at the nozzle.

Using oil-gapped samples may prove advantageous in some applications. However, the system is not limited to oil or air gaps and may include any immiscible fluids. The system may be further generalized to n partitions in the flow stream.

These results show that direct ESI-MS analysis of samples in a segmented flow stream can be performed with little carry-over, good sensitivity, no dilution, and high-speed. Sample consumption is efficient as all the sample that is removed from the well is used in the mass spectrometer. Plugs as small as about 13 nL were used in these experiments, however plugs of different sizes may be used, including plugs ranging from about 1 nL to about 50 nL. An important advantage of this approach to sample introduction is that the duty cycle for the mass spectrometer is high because the time spent rinsing between samples is minimal and every sample plug is automatically injected.

Various patterns of one-dimensional segmented sample arrays may be used to improve or alter performance of the technology for particular applications. For example, plugs containing wash solutions may be segmented between sample plugs in order to clean the emitter nozzle, reduce carry-over, and/or prevent clogging; FIG. 13 is an example. The general scheme of changing the chemical composition of segments between samples for analysis is readily extended to chromatographic separations and on-line solid phase extraction; e.g., FIG. 5.

As an example, reverse phase chromatography may be carried out in a discrete manner. A sample plug containing an organic analyte (such as a protein, peptide, metabolite, organic drug, etc.) would be pushed through and retained by a suitable chromatographic bed (C18 based silica material, by way of example) contained within the fluidic path to the electrospray emitter nozzle. The next fluidic plug, of highly aqueous (>90% water) composition, would wash the retained sample of non-retained and interfering species, such as inorganic cations and anions. Subsequent plugs would be composed of an aqueous/organic co-solvent, such as methanol or acetonitrile suitable to cause the retained analyte to elute from the chromatographic bed. Such elution could be conducted with a single plug of relatively high co-solvent composition (>50% organic) resulting in a one step solid-phase extraction of retained analyte(s).

Alternatively, n number of segments (where n can be between 2 to about 100 or more), could be used to emulate gradient elution chromatography. In this case, each successive plug would be of organic/aqueous composition having a higher percent composition of co-solvent, generating a discrete step elution from the column. This mode is useful for the separation of complex mixtures as chemical species having different retention factors will elute in separate plugs. This general scheme would also work for other modes of liquid chromatographic separation know to those skilled in the art. These include, but are not limited to, normal phase chromatography, hydrophobic interaction chromatography, affinity (ligand-substrate) chromatography, chiral chromatography, ion-exchange chromatograpy, and metal affinity chromatograpy.

It is envisioned that this novel approach to sample introduction for MS can be used in many applications, including high-throughput screening of label-free reactions, off-line coupling of separations methods to ESI-MS, monitoring reactions that are performed in plugs, and clinical diagnostics. These different applications are made possible by taking advantage of microfluidic processing of multiphase flows.

It should be appreciated that the present technology can be used in a wide variety of applications and together with a wide variety of methodological variations. For example, the methods of the present technology may be used and integrated with methods of processing or treating chemical plugs (e.g., samples) such as chromatography (e.g., FIG. 5), solid phase extraction, dialysis (e.g., FIG. 15), concentration, derivatization (e.g., FIG. 6), solvent exchange, etc. that are commonly used in the work flow of sample analysis. Processing may be performed on plugs or droplets before they are formed into a one-dimensional segmented sample array. Processing may also be performed during or after sample segmentation using on-line methods and/or modified flow paths in a continuous or integrated system (e.g., FIGS. 5, 6, and 15). A variety of on-line processing methods for plugs or droplets are known and it is apparent to those skilled in the field that they could be coupled to the present segmented flow ESI-MS methods.

In some embodiments, a chromatography or solid phase extraction column can be included within or in front of the electrospray ionization emitter nozzle; e.g., FIG. 5. Plugs in the segmented sample array are used to perform sequential loading(s), extraction(s), and elution(s) from the column. For example, such chromatography columns may be of packed, monolithic, or open tubular format. In this way, plugs of sample can be further separated based on properties such as affinity, ion exchange, size, reverse phase, etc. The chromatography column may also be a desalting column where ions are separated from analyte(s) in the sample plug prior to electrospray. Where the segmented sample array comprises fractions from a first chromatographic separation, the chromatography column positioned between the segmented sample array and the electrospray ionization emitter nozzle can provide additional separation using a similar or different property. For example, the segmented array may be the output of a size exclusion chromatography column and the chromatography column positioned between the segmented sample array and the electrospray ionization emitter nozzle can be an ion exchange chromatography column.

In some embodiments, the system can include a mechanism for expanding, reducing volume of, or adding segments prior to the electrospray ionization emitter nozzle, such as through the use of a fluidic tee as shown in FIG. 6. This system may be used to add reagents for chemical reactions, add standards for quantitation, and/or chemically modify plugs to make them more compatible with electrospray. Liquid or gas plugs can be added and/or removed from the segmented sample array as it is advanced to the electrospray ionization emitter nozzle. For example, in some cases electrospray and subsequent MS analysis of a certain number of sample plugs in the segmented sample array may not be necessary or desired. These plugs can be removed via the fluidic tee as the segmented sample array is advanced to the electrospray ionization emitter nozzle until particular sample plugs of interest reach the emitter nozzle. In this way, the number of samples and hence the analysis time can be reduced. In some embodiments, wash plugs or plugs used for elution can be added into the segmented sample array using the fluidic tee where a chromatography column is positioned between the segmented sample array and the electrospray ionization emitter nozzle, as shown in FIG. 5.

Although the voltage was typically held constant in the experiments described herein, the spray voltage can be switched on-and-off to only electrospray certain segments. This switching could be synchronized with other signals generated within the system; e.g. optical imaging, light scattering, fluorescent, or conductivity recordings of droplets or plugs. Likewise, AC voltages could be used for different modes of electrostatic spraying.

Additionally, the present technology may be used to continuously load samples from multi-well plates. Currently, a series of segments in a tube is created which is then connected to the emitter and interfaced to the mass spectrometer. However, continuous loading into a flow path directly coupled to an emitter may be better for high throughput applications. For example, the multi-well plate shown in FIG. 23 could be pressurized, or the height could be raised, so that droplets continuously move through the tube, to the emitter nozzle, and are electrosprayed into a mass spectrometer as they are created at the inlet side. Alternatively, pumps based on external fields or peristalsis may be used to constantly withdraw fluid.

Still further, the present technology can be used to develop novel on-line processing methods that improve the performance of the method, aid in incorporation to work flows, and enable new applications. In particular, aspects of the present methods and systems may be used for dialysis including desalting samples (e.g., FIG. 15), extraction, and adding internal standards for quantification (e.g., FIG. 6).

The direct electrostatic spraying (ES) of segmented arrays may also be used for the non-mass spectrometric applications of ES, such as using ES for generating an aerosol for surface coatings, electrospinning polymer fibers, chemical synthesis of (nano)particles, creating chemical arrays on surfaces, printing images, etc. For example if the plugs being electrosprayed are composed of a liquid polymer solution suitable for the electrospinning of polymer fiber, the segmented spray can be used to yield discrete lengths of fiber, with each resulting fiber corresponding to a given plug.

The segmented array and ES system could also be used to store and deliver an image to a substrate. In this case, each plug in the array (e.g., each plug can be composed of a liquid ink or dye of appropriate color, reflectance, etc.) would correspond to a pixel in the resulting printed image. An image would be subsequently generated by ES deposition coupled with an appropriate relative translation of the substrate to the emitter.

The system may be embodied in different forms, as suggested by FIGS. 2, 3, 4, and 5, for improving throughput and functionality.

Embodiments of the present technology further include fraction collection from capillary liquid chromatography (LC) and off-line electrospray ionization mass spectrometry using oil segmented flow (e.g., FIG. 16). Off-line analysis and characterization of samples separated by capillary LC has been problematic using conventional approaches to fraction collection. Systems and methods of the present technology allow collection of nanoliter fractions by forming sample plugs of effluent (e.g., from a 75 μm inner diameter LC column) segmented by spacer plugs of an immiscible oil, such as perfluorodecalin. The segmented array can be stored, for example, in tubing that can then be used to manipulate the samples.

Off-line electrospray ionization mass spectrometry (ESI-MS) can be used to characterize the samples. ESI-MS can be performed by directly pumping the segmented plugs into an electrospray ionization emitter nozzle. Parameters including the choice of spacer plug medium (e.g., oil type), ESI voltage, and flow rates that allow successful direct infusion analysis can be varied to optimize performance. In some case, the best signals are obtained under conditions in which the spacer plug of oil does not form an electrospray and is instead removed from the emitter nozzle. Off-line analysis showed preservation of the chromatogram with no loss of resolution. These methods can be tailored to allow changes in flow rate during the analysis. Specifically, decreases in flow rate can be used to allow extended MS analysis time on selected fractions, similar to "peak parking."

Microscale separation methods such as capillary liquid chromatography (LC) and capillary electrophoresis (CE) are well-recognized as powerful methods that can provide numerous advantages including high resolution, high sensitivity, and effective coupling to mass spectrometry (MS). Limitations of such methods include the relative difficulty of collecting fractions for storage and further characterization of sample fractions off-line. These difficulties stem chiefly from the problems of storing and manipulating the nanoliter and smaller sample fractions that are generated. Conventional methods for fraction collection from a separation method commonly involve transferring samples to wells or vials; however, these approaches are limited in practice to fractions no smaller than a few microliters. Using the present technology, fraction collection from capillary LC based on flow segmentation (i.e., collecting sample fractions as plugs separated by an immiscible oil or gas), followed by off-line electrospray ionization (ESI)-MS of the segmented sample plugs, is demonstrated.

Although on-line ESI-MS is generally effective, fraction collection and off-line ESI-MS may be desirable in many situations including when: 1) using off-site mass spectrometers; 2) using multiple mass spectrometers for analysis of a single sample; 3) only a portion of the chromatogram requires MS analysis; and 4) multiplexing slow separations to rapid MS analysis. Off-line analysis is also desirable when certain fractions of a chromatogram require MS analysis time that is longer than the peak width. This latter situation may arise in analysis of complex samples generated from proteomics or metabolomics studies where multiple stages of mass spectrometry ($MS^n$) may be used to gain chemical information on several overlapping or co-eluting compounds. When using on-line analysis, these problems may be avoided by slowing the entire chromatographic separation; however, this unnecessarily increases analysis time and it may dilute compounds. Alternatively, "peak parking" may be used wherein mobile phase flow is stopped or slowed to allow more time to collect mass spectra when compounds of interest elute. Peak parking is infrequently used because of the complexity of varying flow rate during chromatographic separation and deleterious effects on the separation.

Off-line analysis provides a convenient approach to avoid these limitations. A commercial system for fraction collection and off-line ESI-MS based on a microfabricated chip has been developed. This system uses fraction collection onto well-plates and requires 1-10 μL fractions for ESI-MS analysis. Compartmentalization of effluent into segmented flow has emerged as a novel way to collect fractions from miniaturized separations, such as chip electrophoresis and capillary LC. For capillary LC, fractions were collected as segmented flow to facilitate interfacing to CE for 2-dimensional separation. Both of these examples used on-line analysis and did not explore off-line analysis or interface to mass spectrometry. Thus, there are limitations to these approaches. Performing off-line ESI-MS of fractions requires development of a method of interfacing oil-segmented samples to the ionization source.

As provided by the present technology, sample plugs segmented by spacer plugs of air can be directly infused into a metal-coated nano ESI emitter nozzle to achieve high-throughput, low carry-over between samples, and sensitive ESI-MS analysis. Use of air-segmented samples also has limitations, however. Segments can merge, allowing mixing of fractions, when the pressure required to pump the sample plugs through an ESI emitter is so high it causes compression of the air plugs. Segments can also merge during storage due to evaporation of the air through Teflon™ or polydimethylsiloxane containers. The following experiments provide examples of ESI-MS analysis of oil-segmented samples and the application of fraction collection from capillary LC with subsequent off-line ESI-MS.

The following chemicals and reagents were employed. Capillary LC solvents, including acetonitrile, methanol and water were purchased from Burdick & Jackson (Muskegon, Mich.). Fluorinert™ FC-72, FC-77, FC-40 and perfluorodecalin were from Sigma-Aldrich. Acetic acid and hydrofluoric acid were purchased from Fisher Scientific (Pittsburgh, Pa.). Mobile phases were prepared weekly and were filtered with 0.02 μm-pore filters (Whatman, Maidstone, England) to remove particulates. Fused silica capillary was from Polymicro Technologies (Phoenix, Ariz.). Small molecule metabolites samples malate, citrate, phosphoenolpyruvate (PEP) and fructose 1,6-biphosphate (F1,6P), fumarate, succinate and cyclic adenosine monophosphate (cAMP) were from Sigma-Aldrich. Corticotropin releasing factor (CRF) was from Phoenix Pharmaceuticals, Inc. (Burlingame, Calif.).

Samples were prepared as follows. Metabolite sample stock solutions were made in water at 5 mM concentration then stored at −80° C. Samples were then diluted from stock using 80% methanol and 20% water for injection on a hydrophilic interaction liquid chromatography (HILIC) column.

Analysis of oil-segmented flows with MS was performed as follows. For initial tests of ESI of oil-segmented flow, segmented samples were made by pumping sample (50 μM cAMP dissolved in 50% acetonitrile and 50% ammonium acetate at pH 9.9) and oil into two separate arms of a tee junction with 100 μm i.d. at 500 nL/min using a syringe pump (Fusion 400, Chemyx, Stafford, Tex., USA). In this way, about 7 nL sample plugs separated by about 7 nL oil plugs were formed and pumped into 150 μm i.d. by 360 μm o.d. high purity perfluoroalkoxy plus (HPFA+) tubing (Upchurch Scientific, Oak Harbor, Oreg.) connected to the third arm of the tee.

For off-line ESI-MS detection, the HPFA+tubing containing sample was connected with a Teflon™ connector to a Pt-coated, fused silica ESI emitter nozzle (PicoTip™ EMITTER FS360-50-8, New Objective, Woburn, Mass., USA) with 8 μm i.d. at the tip (see FIG. 16B). The emitter was mounted into a nanospray ESI source (PV-550, New Objective) interfaced to a linear ion trap (LIT) MS (LTQ, Thermo Fisher Scientific, Waltham, Mass.). Unless stated otherwise, samples were pumped at 200 nL/min with the emitter nozzle poised at 1.5 kV. Full scan MS was used in such experiments showing cAMP sample signal at m/z 328. All the other metabolite samples were also detected with negative mode ESI.

Capillary LC Separations were performed as follows. Fraction collection and off-line ESI MS analysis were performed for two different applications each using a different chromatography mode. The first was separation of polar metabolites by hydrophilic interaction liquid chromatography (HILIC). To prepare capillary HILIC columns, a frit was first made by tapping nonporous silica (Micra Scientific, Inc., Northbrook, Ill.) into one end of a 15 cm length of 75 μm i.d. fused silica capillary. The particles were briefly heated with a flame to sinter them in place. The capillary was then packed from a slurry of 8 mg Luna NH2 particles (Phenomenex, Torrance, Calif.) in 4 mL acetone, as described by Kennedy, R. T.; Jorgenson, J. W. Anal. Chem. 1989, 61, 1128-1135. The ESI emitter nozzle was pulled from a separate capillary with 10 μm i.d. and 360 μm o.d. using a 2 cycle program (Cycle 1: HEAT 330, FIL void, DELAY 128, PULL void. Cycle 2: HEAT 330, FIL (void), DELAY 128, PULL 125) on Sutter P-2000 pipette puller (Sutter Instruments, Novato, Calif.). The tip was then etched with 49% hydrofluoric acid for 100 s to create a sharp-edged electrospray emitter nozzle. Separations were performed using a UPLC pump (NanoAcquity, Waters, Milford, Mass.). Mobile phase (MP) A was acetonitrile, while MP B was 5 mM ammonium acetate in water with pH adjusted to 9.9 by NaOH. Separation of metabolites was realized with a linear mobile phase gradient from 30% to 100% MP B over 22 minutes. For on-line detection, the column was interfaced to a triple quadrupole (QQQ) MS (QuattroUltima, Micromass/Waters, Milford, Mass.) using a Waters Universal NanoFlow Sprayer ESI source. Off-line detection was performed with the LIT.

Malate (m/z=133), citrate (m/z=191), PEP (m/z=167) and F1,6P (m/z=339), were separated on a 15 cm long HILIC column with 75 μm i.d. at a flow rate 500 nL/min. Full scan MS was utilized on detection of 1 μL injection of 20 μM of these four fully resolved molecules. For multiple reaction monitoring (MRM) detection, another set of metabolites were used, including fumarate (m/z 115), succinate (m/z 117), malate, cAMP and F1,6P, and the sample concentrations were lowered to 10 μM due to higher sensitivity with MRM detection compared to full scan analysis. Both the QQQ and LIT MS were operated in negative mode. With QQQ, transitions used for MRM detection of these five metabolites were determined to be: m/z 115→m/z 71 for fumarate, m/z 117→m/z 73 for succinate, m/z 133→m/z 115 for malate, m/z 328→m/z 134 for cAMP, and m/z 339→m/z 96 for F1,6P. With LIT MS, daughter ion scans used for MRM of these samples were obtained by setting 5 different scan events to 5 parent ions of different molecules and detecting all daughter ions in a range of 50 to 1000 m/z.

The second application was separation of a tryptic digest of corticotropin-releasing factor (CRF) using reverse phase capillary LC. Instead of using a separate emitter nozzle, the reverse phase columns were made with integrated emitter tips as described by Haskins, W. E.; Wang, Z.; Watson, C. J.; Rostand, R. R.; Witowski, S. R.; Powell, D. H.; Kennedy, R. T. Anal Chem 2001, 73, 5005-5014 and Li, Q.; Zubieta, J. K.; Kennedy, R. T. Anal. Chem. 2009, 81, 2242-2250. Columns were then packed with an acetone slurry (10 mg/mL) of 5 μm Atlantis C18 reversed-phase particles (Alltech, Deerfield, Ill.) at 500 psi to 3 cm length as described by Valaskovic, G. A.; Kelleher, N. L.; Little, D. P.; Aaserud, D. J.; McLafferty, F. W. Anal. Chem. 1995, 67, 3802-3805. 2 μL of 1 nM of the tryptic CRF samples were injected by WPS-3000TPL autosampler (Dionex, Sunnyvale, Calif.) in weak mobile phases (2% acetic acid in $H_2O$) to allow the analytes to stack at the head of the column. The capillary LC system utilizes a high pressure (4000 psi) pump (Haskel Inc., Burbank, Calif.) for sample loading and desalting for 12 min, and a lower pressure (500 psi) micro HPLC pump (MicroPro, Eldex Laboratories, Napa, Calif.) for gradient separation. MP A was water containing 2% acetic acid, while MP B was methanol with 2% acetic acid. The gradient went from 10% to 90% of MP B for 7 min. Both on-line and off-line detection used the LIT MS, operated in positive mode.

Fraction collection was performed as follows. For off-line analysis, LC effluent was collected into fractions using the system shown in FIG. 16. In this approach, effluent from the column is directed into a tee with an immiscible fluid, typically a perfluorinated oil, flowing through another arm of the tee. Within a certain flow rate range, alternating and regularly spaced plugs of sample and oil are formed, as described by Thorsen, T.; Roberts, R. W.; Arnold, F. H.; Quake, S. R. Phys Rev Lett 2001, 86, 4163-4166; Tice, J. D.; Song, H.; Lyon, A. D.; Ismagilov, R. F. Langmuir 2003, 19, 9127-9133; Okushima, S.; Nisisako, T.; Torii, T.; Higuchi, T. Langmuir 2004, 20, 9905-9908; and Garstecki, P.; Fuerstman, M. J.; Stone, H. A.; Whitesides, G. M. Lab Chip 2006, 6, 437-446. Polyether ether ketone (PEEK) tees with 50, 100 and 150 μm i.d. (Valco, Houston, Tex.) were used for this work. The oil-segmented fractions collected into a 60 cm length of 150 μm i.d. by 360 μm o.d. HPFA+ tubing for storage. A picture of the tubing containing such fractions is shown in FIG. 16C.

These experiments produced the following results. With respect to ESI conditions for oil segmented flow, initial studies were directed towards identifying conditions for successful direct infusion ESI-MS of oil-segmented samples. Studies further identified the immiscible fluid used for segmenting samples, electrospray voltage, and infusion flow rate as important parameters for achieving stable and sensitive direct ESI-MS analysis.

Five different liquids, hexane, FC-72, FC-77, FC-40 and perfluorodecalin (PFD), were evaluated as possible immiscible fluids to segment samples. It was observed that hexane, FC-72, and FC-77 all generated a visible electrospray at voltage >−1 kV, which is similar to the lower voltage needed for electrospray of aqueous sample. Attempts to analyze aqueous cAMP samples segmented by these fluids during direct infusion did not yield a series of segments but instead a low and fluctuating ion current as illustrated by the example in FIG. 17A. In contrast, FC-40 and PFD did not yield electrospray up to −1.5 kV. Instead, these oils formed droplets at the emitter nozzle that then migrated along the outside of the nozzle away from the emitter, presumably due to gravity and interfacial tension effects. With these oils, no signal was observed when the oil plug flowed through the nozzle and only sample signal was detected thus allowing detection of cAMP as a series of discrete current bursts corresponding to the plugs exiting the emitter nozzle (FIG. 17B). These results suggest that the electrospray of immiscible segmenting fluid interferes with formation and detection of ions from adjacent aqueous sample plugs. However, the mechanism for this effect is not clear. The difference in oil performance can be attributed, at least in part, to their viscosity. Higher viscosity fluids are more difficult to electrospray, as noted by Kostiainen, R.; Bruins, A. P., Rapid Commun. Mass Spectrom. 1996, 10, 1393-1399 and Kostiainen, R.; Kauppila, T. J., J. Chromatogr. A 2009, 1216, 685-699, and it was the higher viscosity fluids (see Table 1) that could be successfully used in this case.

TABLE 1

Dynamic viscosities of five tested oils at 300 K and comparison to commonly used ESI solvents water and methanol.

| | Hexane | Methanol | FC-72 | Water | FC-77 | FC-40 | PFD |
|---|---|---|---|---|---|---|---|
| Dynamic viscosity (mPa · s) | 0.3 | 0.56 | 0.64 | 0.89 | 1.3 | 3.5 | 5.1 |

Because PFD did not interfere with spray of the sample, further experiments were performed with it as the oil or carrier phase. The effect of ESI voltage was tested while infusing a series of aqueous samples of 50 μM cAMP in full scan mode. As illustrated in FIG. 18, at voltage less than −1.2 kV, no signal for cAMP was observed. At this voltage, neither the aqueous sample nor the oil generated visible electrospray. When the voltage increased to −1.5 kV, signal for the analyte was detected as discrete bursts in the reconstructed ion current (RIC) trace. The total ion current (TIC) revealed a similar pattern showing that no signal was obtained as the oil was pumped through the emitter. In agreement with these observations of the signal, electrospray was observed only for the aqueous plugs in this voltage range. At −1.8 kV, the TIC increased; however, signal for the analyte was reduced in the RIC suggesting that the increase in TIC was due to signal from the oil which begins to electrospray at this voltage. The signal for cAMP also becomes erratic with the onset of oil electrospray. Above −1.8 kV this trend continues and no signal for analyte is detected and the TIC remains noticeably elevated between aqueous plugs. Optimal ESI voltage was thus determined to be around −1.5 kV on the instrument used for the following experiments. With this ESI voltage and sample flow rate, the signal for oil-segmented samples was not statistically different from samples that were directly infused as a continuous aqueous phase suggesting that the presence of oil segments does not interfere with ESI of the samples.

These results further support the conclusion that detection of samples in the aqueous fractions is best if oil does not generate electrospray. For a given oil, the results will be obtained in the range that the aqueous sample generates electrospray but the oil does not. For low viscosity oils such as FC-72 and FC-77, there are no voltages that generate only aqueous spray so these oils did not yield good results under any conditions.

The nano-ESI-MS signal of such sample plugs perfused at 200 nL/min had a RSD for sample plug widths of 38% (n=30). This variability is not due to variation in plug widths because the RSD of plug lengths generated in the tee junction was 3% as measured by visual observation under a microscope. The variability also is not due to complete coalescence of plugs within the ESI nozzle because the number of plugs generated always equaled the number detected by MS. Thus, it appears that this variation is cause by flow through the emitter nozzle. Possible causes include: 1) partial coalescence of plugs; and 2) fluctuations in flow rate associated with segmented flow through the emitter. Data obtained during fraction collection by LC argue against the former case as discussed below. The potential effects of this plug width variation on quantitative LC-MS have yet to be determined; however, we observe that there was little effect on peak heights.

The effect of flow rate was determined as follows. To explore the influence of infusion flow rate, ESI signal for cAMP was monitored from a series of plugs while varying the infusion flow rate. As shown in FIG. 19A, increasing flow rate from 50 nL/min to 200 nL/min, had little effect on the signal magnitude, except samples were introduced more rapidly allowing higher throughput. At a flow rate lower than 400 nL/min, the traces are stable with occasional spikes which had inconsequential influence on average peak heights. Occasional dips in signal may be due to flow instability with this type of experiment. At 50 nL/min some instability may be associated with the emitter nozzle as this is the lower limit recommended for the tips used. All signals shown are raw signals without filtering. As the flow rate was increased to 400 nL/min, however, signal was eliminated. Observation of the emitter nozzle revealed that this loss of signal coincided with accumulation of oil on the nozzle. Thus, at the higher flow rates oil phase exiting the nozzle was not removed fast enough and blocked the emitter nozzle.

To prevent oil accumulation on the emitter nozzle, the oil was siphoned away from the nozzle by placing a 20 cm length of 50 μm i.d. Teflon™ tubing next to the emitter about 1 mm from the tip as shown in FIG. 19C. As oil droplets emerged from the nozzle, they migrated away from the orifice as described above, and were then siphoned into the Teflon™ tubing. In this way, oil did not accumulate on the nozzle. As a result, alternating 10 nL aqueous and oil plugs could be infused at a flow rates up to 2 μL/min without loss of signal (FIG. 19B). With the Teflon™ siphon tubing, the stability of spray of oil-segmented flow could be maintained from 20 to 2000 nL/min.

At the highest flow rate used, the droplets were analyzed at a rate of 2.2 Hz. While high-throughput sample analysis was not a focus of this work, these results suggest that ESI-MS of segmented flow may be a useful route to high-throughput analysis. Higher flow rates were not attempted because the throughput became limited by the MS scan rate, which was 0.13 s per scan for this experiment. To reach higher throughput, a faster detector, such as a time-of-flight MS, could be used.

Fraction collection from capillary LC by oil-segmented flow included the following aspects. Fractions from a capillary LC column were formed by pumping column effluent into a tee with oil flowing perpendicular to the mobile phase as illustrated in FIG. 16(A). It is possible to vary the fraction size by varying the relative flow rates and tee dimensions. Using a 100 μm i.d. tee, 500 nL/min mobile phase flow, and 300 nL/min oil flow generated about 7 nL LC fraction plugs segmented by about 5 nL oil plugs (FIG. 16C). When using tees with 50 and 150 μm i.d., the sample droplet sizes were about 2 nL and about 35 nL respectively. For this work, we used 7 nL droplets which generated 5 to 18 fractions per chromatographic peak depending on the separation. Consistent sample plug sizes (RSD of 4% for 30 plugs visually observed) were obtained for all fractions collected under our LC separation conditions. No obvious difference was observed for sample plugs generated at the beginning of the gradient with 70% acetonitrile and at the end of the gradient with 0% acetonitrile.

Detection of LC separated components offline was performed as follows. To compare off-line detection of fractions with on-line LC-MS detection, a 20 μM mixture of four small molecule metabolites (malate, citrate, PEP and F1,6P) was analyzed using HILIC interfaced to MS both on-line and off-line. For on-line analysis, the components were detected by full scan with a QQQ MS (FIG. 20A). For off-line analysis, the fractions were collected as segmented plugs and 1 hour later infused through a nanoESI emitter nozzle to a LIT MS operated in full scan mode. In the off-line trace (FIG. 20B), the individual LC peaks were cleaved into 10-18 fractions. This number of fractions is sufficient to prevent loss of resolution. As discussed above, it is possible to adjust conditions to yield different fraction volumes depending upon the experiment.

In comparing on-line and off-line analysis, the peak shapes and relative sizes are the same, indicating no extra-column band broadening occurred during fraction storage and analysis. The results support the conclusion that cross-contamination between plugs is low enough to be inconsequential, at least for these examples. Carry-over between plugs would have resulted in peak tailing in the off-line mass chromatograms as the lower concentration plugs and the trailing edge of the peak would be contaminated by the higher concentrations preceding it; however, no extra tailing is observed in the peaks. This observation is in agreement with the results described herein that show low carry-over between peptide samples. Further study with different samples and LC methods is required to determine the generality of this conclusion.

These results also support the idea that the fractions collected were small enough, and created with sufficiently low mixing during formation, as to prevent extra-column band broadening. If necessary, smaller plugs could be generated to avoid such effects if they occur. Resolution is also unaffected; e.g., resolution ($R_s$) for citrate and PEP was calculated to be 2.0 for both on-line and off-line detection.

The most obvious difference in the traces is that the overall times for all four sample peaks are longer in the segmented flow sample (5 min for off-line compared to 8 min for on-line). This difference occurs because the flow rates were kept the same in both methods at 500 nL/min; but, the ratio of oil to sample volume is 3:5, so that infusion of the oil added 3/5 analysis time compared to sample analysis time in the off-line detection. These results illustrate that detection of the chromatogram was unaffected by the storage of those samples in oil-segmented flow and that capillary LC separated components can be preserved for additional analysis off-line. In these experiments, we stored samples for 1-2 h before MS analysis. The present methods and systems can be used for longer term storage of collected fractions, if desired.

By measuring the peak widths of the ion current signal of off-line detection of the fractions, it was shown that there was no difference for sample plugs at high or low organic concentrations, with average peak widths at 0.036 min (n=26) and 0.035 min (n=26), respectively. But the RSDs of peak widths for different sample plugs were higher to 33% (n=26) for plugs in high organic solution or 37% (n=26) for ones in low organic solution. This RSD was similar to the RSD when detecting standard sample plugs, meaning the additional variability is not due to the separation and the fraction collection procedure, but is a factor of the process of nano-ESI on oil segmented flow as described before.

The off-line system was tested for extending the MS analysis time of selected components, analogous to peak-parking, for two examples. The first was to obtain multiple $MS^2$ spectra (i.e., multiple reaction monitoring) for co-eluting peaks using a relatively slow mass spectrometer. For complex samples, multiple reaction monitoring (MRM) is a common method for simultaneous detection and quantification of targeted components. Triple quadrupole MS is generally used for MRM detection because of its ability to rapidly switch between different MS-MS transitions; however, quadrupole ion traps can be advantageous for MRM because they usually have better full scan sensitivity in $MS^2$, and can be used for $MS^n$ analysis, which cannot be done by triple quadrupole MS. A limitation of this approach is that MRM on an ion trap is relatively slow due to longer scan time. For demonstration of off-line ESI-MS with MRM, a test mixture of five metabolites, fumarate, succinate, malate, cAMP and F1,6P at 10 μM each, was analyzed. Fumarate, succinate and malate were allowed to co-elute to illustrate the challenge of MRM for co-eluting compounds. In the experiment, fractions were collected at 0.84 s intervals corresponding to 7 nL samples (flow rate was 500 nL/min).

On-line detection of the three co-eluting compounds gave RICs as shown in FIG. 21A. In the first case of off-line detection, the sample was analyzed by pumping the fractions at 500 nL/min while monitoring MS-MS transitions on a linear ion trap for all 5 analytes, yielding the RICs shown in FIG. 21B. Under this condition, the total time for the 3 co-eluting analytes was about 30 s but the MRM scan time was 1.8 s for each point of one analyte. Therefore, it was possible to only obtain 1 scan for each MS-MS transition over a sample plug, as illustrated in FIG. 21B. Furthermore, not all compounds could be detected in each plug, so for some sample plugs, no signal of a particular compound was detected. For example, the middle RIC in FIG. 21B showed a total of 6 spikes, which were 6 points detected for succinate (m/z 117) peak. However, no signal was detected between the fourth and fifth spike, while a sample plug was seen at the same time, indicating a missing signal for that plug.

The off-line experiment was then repeated but the flow rate was reduced from 500 nL/min to 50 nL/min during the detection of the co-eluting peak (FIG. 21C). Under this condition, the peak width and detection time are increased by a factor of 10. This allows many more scans to be acquired per sample plug and per chromatographic band. For succinate, only 6 scans with S/N>3 were obtained at 500 nL/min as shown in FIG. 21B, while over 80 scans were obtained with the reduced flow rate as shown in FIG. 21C. With the greater scan number, it was also possible to detect the analyte in all the plugs. Meanwhile, the advantages of capillary LC are preserved such as high resolution, improved sample concentration and increased ionization efficiency.

As a second demonstration of the utility of off-line analysis for peak parking, we examined acquiring multiple spectra for compound identification using analysis of a tryptic digest of the peptide CRF as an example. In the separation of CRF tryptic peptides, the flow rate of LC separation was reduced to 100 nL/min to reach better nano-ESI sensitivity. So the oil flow rate was lowered to 60 nL/min to maintain a fixed ratio at 5:3 as well. Compared to the experiment above, despite different flow rates, droplet sizes were the same at 7 nL. With on-line separation at 100 nL/min and full scan MS, the most dominant peak in the chromatogram corresponds to the fragment with m/z 623 (FIG. 22A), but the peak was only about 0.3 min wide which was insufficient to acquire multiple stages of MS with optimized CID manually. To confirm the sequence of this fragment peptide, fractions were collected and off-line ESI analysis performed at 100 nL/min. During elution of the peak of interest, the flow rate was reduced to 25 nL/min. In this way, a 0.3 min wide peak was extended to about 1.8 min width which allowed manual selection of parent ions for $MS^2$ and $MS^3$ analysis. During this time, a series of 8 fractions (i.e., sample plugs) were pumped through the emitter. The parking event was terminated after the $MS^3$ analysis was accomplished. With the spectra, we found the most abundant tryptic fragment of CRF is the peptide CRF1-16 with sequence SEEPPISLDLTFHLLR (SEQ ID NO:1) by comparison with Protein Prospector MS-product database. This software is freely available at the web address [prospector2.ucsf.edu/].

The present systems and methods offer a simple alternative to on-line peak parking. To achieve peak parking with on-line capillary LC-MS, specially designed LC-MS systems are needed to allow the flow rate to be reduced during separation. Thus, when a peak of interest elutes into the MS, the LC flow rate is switched from normal to reduced flow for the extension of analysis time for selected peaks. While this approach is feasible, it has several difficulties. Successful flow rate switching for gradients at low flow rates requires considerable engineering of the flow system. Also, because larger emitter tips yield unstable sprays under these conditions, the best results have typically been obtained from small emitter tips (1-2 μm), which are unfortunately the easiest to be clogged. With the off-line approach however, it was easy to change the flow rate for peak parking by only changing the flow rate of the syringe pump for infusion of the segmented flow into MS. These flow rate changes had little effect on signal intensity over a range of 20 nL/min to 2 μL/min. By decoupling the separation and MS detection, it is possible to maintain the optimal flow rate for separation and MS analysis.

The system described here is also a useful alternative to collecting fractions in a multi-well plate. A primary advantage for this approach is the ease of collecting, manipulating, and analyzing nanoliter or smaller volume fractions which is extremely difficult when using multi-well plates.

Other applications of the fraction collection and off-line analysis can be envisioned. By splitting plugs, using established methods, it would be possible to analyze plugs by different mass spectrometers, NMR, a second dimension of separation, or other methods. Furthermore, plugs could be stored as long as they are stable for later analysis or re-analysis. The system may also be useful for multiplexing a MS. If the chromatographic separation is relatively slow, it may be possible to perform several separations in parallel and then rapidly infuse them into a fast scanning MS, e.g. TOF-MS, for improved throughput.

The present technology has established a method for direct ESI-MS analysis of oil-segmented flow. When coupled with fraction collection from capillary LC, the method allows off-line ESI MS analysis with no extra column band broadening and no mixing of fractions collected. The system was shown to yield mass chromatograms that are equivalent to on-line analysis. With off-line analysis however, it is possible to better match the MS analysis time to the chromatographic peak widths. In this case, we demonstrated the equivalent of peak parking wherein flow rate is slowed for longer MS analysis of selected fractions. The system was demonstrated to be suitable for both reverse phase and HILIC separations. The method illustrates a general approach for preserving low volume components from microscale separation for further manipulation and study. Other applications are possible, such as performing multiple assays on collected fractions. The capability of segmented flow ESI-MS for analysis rates over 2 Hz was also demonstrated. This suggests the potential for using ESI-MS for high-throughput screening in drug discovery and other applications.

The present technology can further provide rapid and label-free screening of enzyme inhibitors using segmented flow electrospray ionization mass spectrometry (ESI-MS). ESI-MS is an attractive analytical tool for high-throughput screening because of the potential for short analysis times and ability to detect compounds without need for labels. Impediments to the use of ESI-MS for screening have been the relatively large sample consumed and slow sample introduction rates associated with commonly used flow injection analysis. The present technology uses segmented flow ESI-MS analysis to improve throughput while reducing sample consumption for screening applications. In embodiments of the present methods, an array of sample plugs with air gaps between them is generated within a capillary tube from a multi-well plate. The sample plugs are infused directly through an ESI emitter nozzle to generate a discrete series of mass spectra from each sample plug.

As a demonstration of the potential of segmented flow ESI-MS for high-throughput screening applications, the method was applied to screening for inhibitors of acetylcholinesterase. At 1 μL/min infusion rate, 102 samples of 10 nL each were analyzed in 2.6 min corresponding to a 0.65 Hz sample analysis rate. Ion current for choline relative to an internal standard was used to quantify the enzyme reaction and detect inhibitors. This signal was linear from 200 μM to 10 mM choline. The assay had a Z'>0.8, indicating that the reproducibility was sufficient for screening. Detailed pharmacological dose-response curves of selected inhibitors were also measured in high-throughput to validate the method.

Drug discovery often requires identification of lead compounds from combinatorial libraries containing millions of candidates. High-throughput screening (HTS) is necessary for such large scale sample handling and measurement. In vitro biochemical assays in multi-well plates with optical detection have been the primary format for HTS. A drawback of optical detection is that usually either labels or indicator reactions must be incorporated into the assay to generate detectable signal. These requirements result in several problems including increased difficulty of assay development, increased cost because of added or complex reagents, and greater potential for inaccurate results if test compounds affect the label or indicator reaction rather than the test reaction. High-throughput assays that can be performed without labels or indicator reactions are therefore of great interest.

A powerful label-free detection system is electrospray ionization mass spectrometry (ESI-MS). Indeed, a variety of ESI-MS assays for enzymes and non-covalent biomolecular binding events can be used for screening applications. The throughput achievable by ESI-MS is limited by the need to interface the mass spectrometer to multi-well plates and perform individual injections for each assay. This limit assumes the standard procedure of testing one compound at a time. For certain assays, MS can analyze a mixture of test compounds at one time. Currently, individual samples are most often introduced to a mass spectrometer by flow injection; i.e., loading sample into an HPLC-style injection valve and then pumping it through the ESI emitter. It is a significant challenge to engineer a rapid injection system that uses small volumes, has low carry-over between injections, uses low flow rates, and is reliable. A rapid system that requires just 4-5 s per analysis and consumes 1-5 μL of sample is commercially available, as described by Shiau, A. K.; Massari, M. E.; Ozbal, C. C. Back to Basics: Label-Free Technologies for Small Molecule Screening. Comb. Chem. High Throughput Screening. 2008, 11, 231-237. However, more common systems are considerably slower and require a few minutes per sample. For HTS, it is desirable to lower the volume of sample consumed, to reduce reagent costs, and to further increase throughput.

With the present systems and methods, the need for flow injection is eliminated by utilizing segmented flow analysis for high-throughput ESI-MS. Segmented flow has long been a popular method for improving throughput in clinical analysis. In the classical scheme, individual samples are segmented by air in a tube, reagents added for colorimetric assay, and the samples passed through an optical detector. There has been a resurgence of interest in segmented flow with the advent of sophisticated microfluidics that allow miniaturization (e.g., femtoliter to nanoliter samples) and new methods for manipulating sample plugs and droplets. As demonstrated herein, directly pumping segmented flow through an ESI emitter nozzle to obtain mass spectrometric analysis of discrete sample plugs at high-throughput (0.8 Hz analysis rate) with low carry-over (<0.1%) between plugs can be done.

As a test system, screening for inhibitors of acetylcholinesterase (AchE) was chosen. AchE catalyzes conversion of acetylcholine to choline and is the primary agent for terminating acetylcholine signaling at synapses. For example, inhibition of AchE is a possible treatment for Alzheimer's disease (AD) and related dementia. While a handful of AchE inhibitors have been approved for AD treatment, searching for compounds with improved pharmacological and toxicological properties remains an active pursuit.

Because the AchE reaction does not generate components that are easily detected optically, screening has required coupling the enzyme with indicator reactions. It has been demonstrated that AchE assays can be performed using flow-injection ESI-MS and HPLC-MS to directly detect substrate and/or product of the reaction, as described by Ingkaninan, K.; de Best, C. M.; van der Heijden, R.; Hofte, A. J. P.; Karabatak, B.; Irth, H.; Tjaden, U. R.; van der Greef, J.; Verpoorte, R. High-Performance Liquid Chromatography with on-Line Coupled UV, Mass Spectrometric and Biochemical Detection for Identification of Acetylcholinesterase Inhibitors from Natural Products. J Chromatogr A. 2000, 872, 61-73 and Ozbal, C. C.; LaMarr, W. A.; Linton, J. R.; Green, D. F.; Katz, A.; Morrison, T. B.; Brenan, C. J. H. High Throughput Screening Via Mass Spectrometry: A Case Study Using Acetylcholinesterase. Assay and Drug Development Technologies. 2004, 2, 373-381. Throughput of 0.2 Hz with 1-5 μL of sample consumption was possible when using automated sampling and injection. The present experiments demonstrate that with direct ESI-MS analysis of segmented assay mixtures we can generate a throughput of 0.65 Hz for AchE inhibitor screening while consuming only 10 nL of sample and achieving excellent reproducibility.

The following chemicals and reagents were employed. Water and methanol were purchased from Burdick & Jackson (Muskegon, Mich.). Acetic acid was purchased from Fisher Scientific (Pittsburgh, Pa.). All other chemicals were obtained from Sigma (St. Louis, Mo.).

AchE activity was measured as follows. Assay conditions were modified from the method described by Hu, F. L.; Zhang, H. Y.; Lin, H. Q.; Deng, C. H.; Zhang, X. M. Enzyme Inhibitor Screening by Electrospray Mass Spectrometry with Immobilized Enzyme on Magnetic Silica Microspheres. J. Am. Soc. Mass Spectrom. 2008, 19, 865-873. 10 mM $NH_4HCO_3$ was used as reaction buffer for all AchE experiments. AchE (from Electrophorus electricus, Type VI-S) was prepared daily from lyophilized powder at 90 μg/mL solution. 2 μL of drug solution to be tested was mixed with 20 μL AchE solution and incubated on ice for 30 min before being brought to room temperature. 20 μL of 200 mM acetylcholine iodide solution was then added to the AchE solution to start hydrolysis. After 20 min incubation, 180 μL of an ice-cold aqueous mixture containing 1 mM chlormequat, 60:40 (v/v) methanol and 1.5% (v/v) acetic acid was rapidly mixed with 20 μL of the enzyme mixture to terminate the reaction. 30 μL of each final quenched reaction mixture was pipetted into a 384-well plate (Corning, Fisher Scientific, Pittsburg, Pa.) for loading into a sample tube for analysis.

Air-segmented sample plugs from samples in a 384-well plate were generated using the system illustrated in FIG. 23. A Teflon™ tube of 75 μm inner diameter (i.d.) and 360 μm outer diameter (o.d.) (IDEX Health & Science, Oak Harbor, Wash.) was used for sampling and storing sample plugs. One end of this tubing was connected to a 100 μL syringe (Hamilton, Fisher Scientific, Pittsburg, Pa.) using a 250 μm bore PEEK union (Valco Instruments, Houston, Tex.). The syringe and Teflon™ tubing were initially filled with Fluorinert™ FC-40 (Sigma). The syringe was mounted onto a PHD 200 programmable syringe pump (Harvard Apparatus, Holliston, Mass.). To fill the tube with air-segmented samples, a computer-controlled xyz-micropositioner (built in-house from XSlide™ assemblies, Velmex Inc., Bloomfield, N.Y.) was used to move the inlet of the Teflon™ tubing from sample-to-sample on the multi-well plate while the pump was operated at a fixed aspiration rate. By using an aspiration rate of 200 nL/min, 10 nL sample plugs and 4 mm long air plugs were produced. Using this procedure, a tube could be filled with 100 samples in about 10 min. The relative standard deviation of sample plug size was 25% due to the compressibility of air affecting the sampling rate with increasing amount of air in the tube.

After sample plug generation, the inlet end of the Teflon™ tubing was connected to a Pt-coated fused-silica electrospray emitter (FS 360-50-8-CE, New Objective, Woburn, Mass.), which was 50 μm i.d. and pulled to 8 μm i.d. at the tip, using a short length of 360 i.d. Teflon™ tubing. The emitter was mounted in a nanospray source (PV-550, New Objective). A syringe pump operated at 1.0 μL/min was used to drive sample plugs through the emitter poised at +1.7 kV for ESI-MS analysis. MS analysis was performed using a LTQ XL linear ion trap MS (Thermo Fisher Scientific, Waltham, Mass.) operated in single-stage, full-scan mode with following settings: automatic gain control (AGC) on, negative mode, 50-300 m/z scan range and micro scan number=1. Scan time was approximately 0.1 s. RICs of choline (m/z 104)

and chlormequat (m/z 122) were extracted from TIC for analysis. Peak marking and analysis were performed automatically using Qual Browser. For determining inhibitor $IC_{50}$ values, GraphPad Prism 3.0 (GraphPad Software, San Diego, Calif.) was used for curve fitting and analysis.

Initial experiments were directed at determining AchE assay conditions that would be compatible with ESI-MS. Incubating acetylcholine with AchE in 10 mM $NH_4HCO_3$ buffer for 20 min at room temperature followed by quenching of the reaction by addition of a methanol and acetic acid mixture was found to be suitable. With this incubation time, <10% of the original acetylcholine was consumed thus ensuring linear hydrolysis rates. The quenching solvent was found to completely stop the enzymatic reaction and be compatible with MS. $NH_4HCO_3$ provided adequate buffering while being compatible with ESI. To improve quantification, chlormequat was included in the quenching solution to act as an internal standard. Typical MS spectra illustrating detection of substrate (acetylcholine), product (choline), and internal standard are shown in FIG. 24. Under the electrospray conditions used, the spectra are free from interfering peaks from the Fluorinert™ FC-40 used for coating the Teflon™ tubing. Inhibitors added to the assay reduced the choline signal as shown by FIG. 24.

Segmented flow ESI-MS analysis for rapid screening was performed as follows. To demonstrate rapid screening of AchE inhibitors, a set of 32 compounds including four known AchE inhibitors and 28 randomly picked compounds were tested at 100 μM each in the AchE assay mixtures. For screening, each compound was tested in triplicate resulting in a total of 102 samples (96 assay samples, plus 3 blanks with no enzyme added, and 3 controls with no test compound added). These samples were loaded into a Teflon™ tube as a linear array using the procedure described herein. Throughput of analysis is determined by sample plug volume and flow rate into the ESI source so that small sample volumes and high flow rates generate higher throughput. For this work, 10 nL sample plugs with 17 nL air gaps (or 4 mm spacing in a 150 μm i.d. tubing) were chosen as a small volume that was convenient to produce. Samples were pumped through the emitter at 1 μL/min, which was the highest flow rate that did not cause the samples to coalesce in the emitter nozzle because of compression of the air segment.

These conditions allowed the 102 samples to be analyzed in 2.6 min, corresponding to an analysis rate of 0.65 Hz, as illustrated by ion current trace shown in FIG. 25A. Each sample is detected as a current burst followed by a period of zero current corresponding to the air segment passing through the emitter. As shown, the current rapidly stabilizes for each sample and remains steady as the sample is passed through the emitter. The presence of inhibitors is easily visualized by the reduced choline signal relative to internal standard signal in these traces. The inconsequential carry-over between samples is illustrated by the immediate step change in signal between samples of different choline concentrations.

The throughput of the segmented flow method compares favorably to previously reported flow injection AchE assays, as described in Ingkaninan, K.; de Best, C. M.; van der Heijden, R.; Hofte, A. J. P.; Karabatak, B.; Irth, H.; Tjaden, U. R.; van der Greef, J.; Verpoorte, R. High-Performance Liquid Chromatography with on-Line Coupled UV, Mass Spectrometric and Biochemical Detection for Identification of Acetylcholinesterase Inhibitors from Natural Products. J Chromatogr A. 2000, 872, 61-73; Ozbal, C. C.; LaMarr, W. A.; Linton, J. R.; Green, D. F.; Katz, A.; Morrison, T. B.; Brenan, C. J. H. High Throughput Screening Via Mass Spectrometry: A Case Study Using Acetylcholinesterase. Assay and Drug Development Technologies. 2004, 2, 373-381; and Andrisano, V.; Bartolini, M.; Gotti, R.; Cavrini, V.; Felix, G. Determination of Inhibitors' Potency (IC50) by a Direct High-Performance Liquid Chromatographic Method on an Immobilised Acetylcholinesterase Column. J Chromatogr B. 2001, 753, 375-383. The speed of these methods was limited by the need to inject individual samples or additional separation steps when assay buffer was not directly compatible with ESI-MS.

Further improvements in throughput using the methods reported here are feasible. Generating lower volume samples would decrease the time required to analyze each sample at a given flow rate. Smaller samples may be prepared by using smaller i.d. sample tubing or by using a more sophisticated positioner that can move faster from well-to-well (relatively slow translation rate of the positioners used here prevented shorter aspiration times that would generate smaller sample plugs). Higher flow rates would also improve analysis rates. In other experiments described herein (e.g. FIG. 19), we have found that using a fluorinated oil instead of air to segment the samples allows higher flow rates while avoiding the limiting effect of air compressibility. Ultimately, the analysis rate may be limited by the scan time of the mass spectrometer used.

To quantify choline production in the enzyme reaction, four different measurements were evaluated, as shown in FIG. 26A. Absolute choline peak area had the most variability which was not surprising because the size of sample plugs had 25% variability. Peak heights were less variable but could sometimes be affected by fluctuation in electrospray stability. Choline peak area and height relative to the internal standard had low variability and both proved to be equally acceptable for quantification.

Charge competition between choline and internal standard chlormequat during electrospray and its effect on quantification was also evaluated. Choline signal intensity was measured at various choline concentrations with a fixed chlormequat concentration. As shown in FIG. 26B, choline signal increased with its concentration non-linearly while chlormequat signal decreased with increasing choline concentration. By using choline signal relative to the internal standard, a linear calibration curve could be obtained (see FIG. 26B) demonstrating that the use of internal standard also helped to correct for charge competition during ESI at different choline concentrations.

FIG. 25B summarizes quantification of the assay screen shown in FIG. 25A using peak area ratio for choline and internal standard. Four of the known AchE inhibitors showed reduced choline production as expected. Interestingly, isoproterenol and DMSO also showed some inhibition at this concentration. DMSO increased signal of both choline and chlormequat; however, quantification was not affected since relative signal intensities were used. This result indicates that the assay should be resistant to compounds that have generalized effects on the ESI-MS process.

The reproducibility of the assay can be evaluated using the Z'-factor. The Z'-factor is defined as $Z'=1.0-(3.0\times(s_{neg}+s_{pos})/R$, where $s_{neg}$ is the standard deviation of the response of a negative control (no inhibitor), $s_{pos}$ is the standard deviation of the response of a positive control (with inhibitor), and R is the difference in signal between the mean of positive and negative controls. Z' over 0.5 is generally considered a good assay for HTS. In our experiments, Z' values for neostigmine, eserine, malathion and edrophonium were 0.84, 0.83, 0.87, and 0.85 respectively. High Z' values were the direct result of excellent reproducibility of the segmented flow ESI-MS assay.

Another use of the assay is for rapid determination of dose-response relationships for known inhibitors, as illustrated for neostigmine, eserine, malathion, and edrophonium in FIG. 27. For this experiment, 10 different concentrations of each inhibitor ranging from 0 nM to 10 mM were incubated with the assay mixtures for 20 min at room temperature. The quenched reaction mixtures were analyzed and absolute choline formation was derived from the choline calibration curve. $IC_{50}$s of eserine, malathion and edrophonium were calculated to be 63±13 nM, 480±70 μM, 63±11 μM respectively. Neostigmine resulted in two $IC_{50}$ values, 50±25 μM and 38±10 nM, based on two-site competition fitting. These numbers generally agree well with previously reported values (eserine 72-109 nM, malathion 370 μM, edrophonium 5.4 μM, and neostigmine 11.3 nM, as described by Vinutha, B.; Prashanth, D.; Salma, K.; Sreeja, S. L.; Pratiti, D.; Padmaja, R.; Radhika, S.; Amit, A.; Venkateshwarlu, K.; Deepak, M. Screening of Selected Indian Medicinal Plants for Acetylcholinesterase Inhibitory Activity. J Ethnopharmacol. 2007, 109, 359-363; Krstic, D. Z.; Colovic, M.; Kralj, M. B.; Franko, M.; Krinulovic, K.; Trebse, P.; Vasic, V. Inhibition of AchE by Malathion and Some Structurally Similar Compounds. J. Enzyme Inhib. Med. Chem. 2008, 23, 562-573; Alvarez, A.; Alarcon, R.; Opazo, C.; Campos, E. O.; Munoz, F. J.; Calderon, F. H.; Dajas, F.; Gentry, M. K.; Doctor, B. P.; De Mello, F. G.; Inestrosa, N. C. Stable Complexes Involving Acetylcholinesterase and Amyloid-Beta Peptide Change the Biochemical Properties of the Enzyme and Increase the Neurotoxicity of Alzheimer's Fibrils. J. Neurosci. 1998, 18, 3213-3223; and Iwanaga, Y.; Kimura, T.; Miyashita, N.; Morikawa, K.; Nagata, O.; Itoh, Z.; Kondo, Y. Characterization of Acetylcholinesterase Inhibition by Itopride. Jpn. J. Pharmacol. 1994, 66, 317-322.); however, direct comparison of these numbers might not be appropriate because the experimental conditions were not identical (e.g., use of surrogate substrates and different AchE in other assays). For this experiment, all 120 samples (40 individual samples in triplicate) were analyzed by segmented flow ESI-MS in 3 min illustrating the potential for rapidly quantifying enzyme inhibition.

We demonstrated that AchE inhibitors could be screened at throughput of 1.5 sec/sample by preparing samples as an array of individual nanoliter plugs segmented by air and analyzing them in series using ESI-MS. The throughput achieved here showed a significant improvement over other screening methods since it did not require flow injection of individual samples. Even higher throughput may be possible by analyzing smaller sample plugs and higher flow rates. Another advantage of segmented flow analysis relative to flow injection approaches is the low sample volume requirement. Only 10 nL of sample was consumed in this assay because there is no need to fill and rinse an injection loop. Of course, the total sample used depends on the volume required to collect the 10 nL sample. In principle, it should be possible to aspirate sample from much lower volume wells than used here.

Although our experiments illustrate the possibility of rapid analysis of assay mixtures by MS, a complete HTS system would require consideration of all aspects of the screen for high-throughput. For example, in the present experiments the overall throughput was limited by loading of samples into the tube for the assay. Parallel loading of tubes and higher flow rates during loading are approaches that may be used to improve throughput of this aspect of the method. It may be possible to perform continuous loading of tubes and transfer to ESI-MS as described herein for this application. It may also be possible to perform the entire assay in plugs to save reagent costs and time. Several tools for manipulating plugs are known, including mixing with streams, reagent addition, and splitting, as described by Song, H.; Chen, D. L.; Ismagilov, R. F. Reactions in Droplets in Microflulidic Channels. Angew. Chem.-Int. Edit. 2006, 45, 7336-7356; Link, D. R.; Anna, S. L.; Weitz, D. A.; Stone, H. A. Geometrically Mediated Breakup of Drops in Microfluidic Devices. Phys. Rev. Lett. 2004, 92, 054503; and Chabert, M.; Dorfman, K. D.; de Cremoux, P.; Roeraade, J.; Viovy, J. L. Automated Microdroplet Platform for Sample Manipulation and Polymerase Chain Reaction. Anal. Chem. 2006, 78, 7722-7728. Thus, it is possible to envision a system in which a chemical library is stored as a series of plugs that is then tested and assayed by MS and by-passing the transfer from multi-well plate to tubing.

Another consideration in overall throughput is sample preparation. The Acetylcholine assay was compatible with ESI; however, some assays may require desalting or extraction prior to analysis. Development of such methods that are compatible with multi-well plates or segmented flow will be required to further the applicability of this approach.

The present systems and methods may employ various suitable arrangements for the electrospray ionization emitter nozzle and the application of spray voltage. The preferred embodiment for the electrospray ionization emitter nozzle is one in which the sample plug that is present at the end of the nozzle, is in electrical contact with the electrospray circuit and power supply. The power supply generates an electrical potential (voltage) between the nozzle electrode and the counter-electrode, creating an electrical circuit.

The electrospray ionization emitter nozzle may be made from an electrically conductive, or non-conductive material. One especially preferred method is to use an emitter fabricated from fused-silica tubing having a surface coating of an electrically conductive material, such as platinum. Thus, when the sample plug makes contact with the end of the emitter, it will be in direct electrical contact with the electrospray power supply. Sheath-gas assisted electrospray, known to those skilled in the art of electrospray, is preferable when using liquid flow rates of greater than 1 uL/min. Also suitable are configurations where the high voltage is placed on the counter-electrode and where the emitter nozzle is left at ground potential.

Electrical contact may also be made in a junction style arrangement where the voltage contact is made directly with the sample plug through an electrode placed up-stream of the nozzle orifice, enabling the use of electrically non-conductive tips or nozzles. In this case it is preferable for the volume downstream of the electrode, to the end of the emitter nozzle, to be less than the volume of the sample plug, and especially preferable for the downstream volume be less than or equal to 50% of the sample plug volume. This arrangement is particularly advantageous wherein the sample plugs are separated by an electrically insulating liquid spacer medium, such as fluorinated oil. As discussed, in some embodiments it is preferable to prevent the oil plugs from spraying from the nozzle. The relative volumes of the spacer plug, sample plug, and post-electrode volume can be controlled to promote the spraying of the sample plug while minimizing spraying of the spacer medium. This general condition is met: sample plug volume>the post-electrode-to-nozzle volume>spacer plug volume. It is especially preferable if the sample plug volume is minimally twice the post-electrode volume, and for the spacer plug volume to be half the post-electrode volume.

Suitable electrospray ionization emitter nozzles include those fabricated from: metals such as steel, stainless steel, electro-formed nickel, platinum, and gold; from insulators such as fused-silica, glass; from metal coated fused-silica or glass; polymers such as polypropylene and polyethylene, conductive polymers such as polyanaline and carbon loaded polyethylene. Suitable nozzles may vary widely in inner diameter (ID), outer diameter (OD) and taper geometry. OD's, with appropriately corresponding ID's may range anywhere from 1-10 mm to 1-10 μm and anywhere in between. Nozzles with an OD of less than 0.5 mm being preferred, with those less than 100 μm being more preferred, and those in the range of 0.1 to 30 μm being especially preferred.

The present systems and methods may further employ various materials to contain the one-dimensional segmented sample array. The linear array of segments can be formed, stored, and/or transferred between various types of vessels, tubes, or containers. For example, tubing of various inner diameters may be used and microfabricated channels in various substrates may be used with different dimensions and flow rates. Various microfluidic devices, commonly referred to as lab-on-a-chip devices, may be used to form, store, and manipulate one or more one-dimensional segmented sample arrays.

Aspects of the container for the one-dimensional segmented sample array are discussed in terms of a tube, although various other vessels, channels, or containers may be used as noted. The optimal choice of material in terms of surface texture and chemical composition for the tube is such that the material does not interfere with the segmentation of the carrier and sample segments in the tube. Depending on the exact nature of the composition of the carrier and sample segments (chemical composition, pH) a given material for one combination may not be suitable for other combinations. Suitable combinations may be found by empirical practice and directly observing the flow of segments through the tube or channel. It is preferable, but not necessary, for the tube material to be wetted by the carrier (i.e. segmentation) phase separating sample plugs, and surface-phobic relative to the sample mobile phase. It is preferable for the surface chemistry of the tube material to have a similar surface energy as the carrier phase for the case of a liquid carrier phase, and a differing surface energy from the sample phase.

Suitable materials for the container for the one-dimensional segmented sample array include metals, synthetic polymers, glass, or ceramics. Preferable metals include the stainless steels, platinum, gold, nickel, and nickel alloys such as electroformed nickel. Preferable polymers include the class of engineering thermoplastic and thermosetting polymers: polyethylene, polyproprylene, PEEK™ (polyetherether ketone), polycarbonate, polymethylmethacrylate, Ultem™ (polyetherimide), polyimide, Halar™ (ethylenechlorotrifluoroethylene), Radel™ A(polyethersulphone), Radel™ R (polyphenylsulfone), Tefzel™ (ethylene-tetrafuoroethylene), and Teflon™ (polytetrafluoroethylene). Particularly preferable materials include flexible, elastomeric polymers including one or two-part RTV silicones such as polydimethylsiloxane; Tygon™; fluoropolymers such as Teflon™ ETFE, Teflon™ FEP, Teflon™ PFA, and Kel-F™. Preferable glasses include borosilicate glass, synthetic fused-silica, and polyimide coated fused silica tubing. Preferable ceramics include Alumina, Zirconia enriched Alumina, and Macor™ (fluorophlogopite mica and borosilicate glass).

Tubes may also be altered to have a suitable surface chemistry through the application of surface coatings. For example, fused-silica tubing can be altered with a reactive perfluorinated silane reagent (FluoroSyl™, Cytonix Corporation) rendering the tubing surface as hydrophobic.

For most materials, smooth surfaces for the interior of the tube channel are preferred to enable efficient transport of the sample plugs. However, newer classes of bio-memetic, superhydrophic surfaces have been created by nanocompositie materials possessing surface texture on the sub-micrometer scale. Such nano-engineered materials make suitable coatings for glass or silica substrates. One example is the so-called nanopin film (J. Am. Chem. Soc.; 2005; 127(39) pp 13458-13459), resulting from the formation of cobalt (II) hydroxide on the surface of borosilicate glass by reaction with cobalt chloride hexahydrate.

Suitable fabrication methods for the tubes include common materials fabrication methods of drilling, machining, injection molding, cavity molding, powder injection molding, die forming, drawing, and extrusion.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The following is a non-limiting discussion of terminology used to describe the present technology.

The headings (such as "Introduction" and "Summary") and sub-headings used herein are intended only for general organization of topics within the present disclosure, and are not intended to limit the disclosure of the technology or any aspect thereof. In particular, subject matter disclosed in the "Introduction" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

The citation of references herein does not constitute an admission that those references are prior art or have any relevance to the patentability of the technology disclosed herein. All references cited in the "Detailed Description" section of this specification are hereby incorporated by reference in their entirety.

The description and specific examples, while indicating embodiments of the technology, are intended for purposes of illustration only and are not intended to limit the scope of the technology. Moreover, recitation of multiple embodiments having stated features is not intended to exclude other embodiments having additional features, or other embodiments incorporating different combinations of the stated features. Specific examples are provided for illustrative purposes of how to make and use the compositions and methods of this technology and, unless explicitly stated otherwise, are not intended to be a representation that given embodiments of this technology have, or have not, been made or tested.

As used herein, the words "desire" or "desirable" refer to embodiments of the technology that afford certain benefits, under certain circumstances. However, other embodiments may also be desirable, under the same or other circumstances. Furthermore, the recitation of one or more desired embodiments does not imply that other embodiments are not useful, and is not intended to exclude other embodiments from the scope of the technology.

As used herein, the word "include," and its variants, is intended to be non-limiting, such that recitation of items in a list is not to the exclusion of other like items that may also be useful in the materials, compositions, devices, and methods of this technology. Similarly, the terms "can" and "may" and their variants are intended to be non-limiting, such that recitation that an embodiment can or may comprise certain elements or features does not exclude other embodiments of the present technology that do not contain those elements or features.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components or process steps, the present technology also specifically includes embodiments consisting of, or consisting essentially of, such materials, components or processes excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, all compositional percentages are by weight of the total composition, unless otherwise specified. Disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as temperatures, molecular weights, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

When an element or layer is referred to as being "on", "engaged to", "connected to" or "coupled to" another element or layer, it may be directly on, engaged, connected or coupled to the other element or layer, or intervening elements or layers may be present. As used herein, the term "and/or" includes any and all combinations of one or more of the associated listed items.

SEQUENCE LISTING

```
<160> NUMBER OF SEQ ID NOS: 1

<210> SEQ ID NO 1
<211> LENGTH: 16
<212> TYPE: PRT
<213> ORGANISM: Homo sapiens
<220> FEATURE:
<221> NAME/KEY: PEPTIDE
<222> LOCATION: (1)..(16)
<223> OTHER INFORMATION: Tryptic digest fragment of corticotropin
      releasing factor (CRF).

<400> SEQUENCE: 1

Ser Glu Glu Pro Pro Ile Ser Leu Asp Leu Thr Phe His Leu Leu Arg
1               5                   10                  15
```

What is claimed is:

1. A system for electrospray ionization of discrete samples, the system comprising:

an electrospray ionization emitter nozzle;

a one-dimensional segmented sample array directly coupled to the electrospray ionization emitter nozzle, the array comprising a plurality of sample plugs including a first medium, the sample plugs separated by spacer plugs including a second medium;

a pumping means operable to advance the array to the electrospray ionization emitter nozzle; and a power supply electrically coupled to a sample plug within or proximate to the electrospray ionization emitter nozzle and electrically coupled to a spray receiver.

2. The system of claim 1, wherein each sample plug comprises a volume of about 1 nL to about 50 nL.

3. The system of claim 1, wherein the one-dimensional segmented sample array is within a tube or within a channel of a microfabricated fluidic device.

4. The system of claim 3, wherein the tube has an inner diameter from about 75 micrometers to about 150 micrometers.

5. A method of operating a system according to claim 3, comprising pre-filling the tube or channel with the second medium followed by filling the tube or channel with the one-dimensional segmented sample array.

6. The system of claim 1, wherein the first medium and second medium are immiscible or wherein the first medium comprises a liquid and the second medium comprises a gas.

7. The system of claim 1, wherein the one-dimensional segmented sample array further comprises gas plugs comprising a third medium, wherein the first medium and second medium comprise immiscible liquids and the third medium comprises a gas.

8. The system of claim 7, wherein the one-dimensional segmented sample array comprises repeating units of a sample plug followed by a spacer plug followed by a gas plug.

9. The system of claim 7, wherein the one-dimensional segmented sample array comprises gas plugs separating the sample plugs and spacer plugs.

10. The system of claim 1, wherein the one-dimensional segmented sample array further comprises wash plugs.

11. The system of claim 10, wherein a sample plug is located between the wash plug and the electrospray ionization emitter nozzle.

12. The system of claim 1, wherein the spray receiver further comprises a mass spectrometer.

13. A method of operating a system according to claim 12, comprising analyzing an electrosprayed droplet using the mass spectrometer, wherein the electrosprayed droplet is formed by using the pump to advance the one-dimensional segmented sample array through the electrospray ionization emitter.

14. The system of claim 1, further comprising a means for removing a droplet formed at the electrospray ionization emitter nozzle.

15. The system of claim 14, wherein the means for removing a droplet formed at the electrospray ionization emitter nozzle comprises a coaxial or parallel lumen operable to siphon the droplet from the nozzle or a capillary wicking structure operable to draw the droplet away from the nozzle.

16. The system of claim 1, wherein the first medium comprises an aqueous medium and the second medium comprises a hydrophobic medium having a viscosity greater than about 3.5 mPa·s.

17. The system of claim 1, wherein the first medium comprises an aqueous medium and the second medium comprises a hydrophobic medium and the electrospray voltage is set to electrospray the first medium and to not electrospray the second medium.

18. The system of claim 1, wherein the sample plugs comprise liquid chromatography fractions, a chemical library, or a series of reaction mixtures.

19. A method of operating a system according to claim 18, comprising collecting at least a portion of the liquid chromatography fractions at a first rate to form the one-dimensional segmented sample array and advancing the one-dimensional segmented sample array to the electrospray ionization emitter nozzle at a second rate, wherein the first rate and the second rate are different.

20. The system of claim 1, further comprising a dialysis membrane positioned between the one-dimensional segmented sample array and the electrospray ionization emitter nozzle.

21. The system of claim 1, further comprising a chromatography column positioned between the one-dimensional segmented sample array and the electrospray ionization emitter nozzle.

22. The system of claim 1, further comprising a fluidic junction coupled to the one-dimensional segmented sample array, wherein a portion of the one-dimensional segmented sample array is positioned between the fluidic junction and the electrospray ionization emitter nozzle.

23. A method of operating a system according to claim 22, wherein a fourth medium is added to a sample plug via the fluidic junction.

24. The method of claim 23, wherein the fourth medium comprises an enzyme.

25. A method of operating a system according to claim 22, wherein a liquid or gas is introduced into the one-dimensional segmented sample array via the fluidic junction.

26. The system of claim 1, wherein the pumping means is provided by a syringe pump, reciprocating piston pump, peristaltic pump, gas-pressure pump, electroosmosis, or gravity.

27. A method of operating a system according to claim 1, comprising advancing the one-dimensional segmented sample array to the electrospray ionization emitter nozzle with the pump and electrospraying a sample plug.

28. The method of claim 27, wherein the advancing is performed at a rate of about 20 nL/min to about 20 μL/min.

29. A method of operating a system according to claim 1, comprising forming the one-dimensional segmented sample array off-line followed by directly coupling the array to the electrospray ionization emitter nozzle.

30. The method of claim 29, wherein at least one hour passes between forming the one-dimensional segmented sample array off-line and directly coupling the array to the electrospray ionization emitter nozzle.

31. A method of operating a system according to claim 1, wherein the first medium comprises an aqueous medium and the second medium comprises a hydrophobic medium, the method comprising adjusting the electrospray voltage to electrospray the first medium and to not electrospray the second medium.

* * * * *